US008051508B2

(12) United States Patent
Yu et al.

(10) Patent No.: US 8,051,508 B2
(45) Date of Patent: Nov. 8, 2011

(54) PLAYPEN HUB ASSEMBLY

(75) Inventors: Fu-Sian Yu, Taipei (TW); Xiao-Long Mo, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 327 days.

(21) Appl. No.: 12/425,381

(22) Filed: Apr. 17, 2009

(65) Prior Publication Data

US 2009/0260156 A1 Oct. 22, 2009

(30) Foreign Application Priority Data

Apr. 18, 2008 (CN) ..... 2008 2 0105283 U
Mar. 18, 2009 (CN) ..... 2009 2 0008738 U

(51) Int. Cl.
*A47D 13/06* (2006.01)

(52) U.S. Cl. ..... 5/98.1; 5/99.1; 403/102

(58) Field of Classification Search ..... 5/98.1, 5/99.1; 403/102
See application file for complete search history.

(56) References Cited

U.S. PATENT DOCUMENTS 5,465,439 A 11/1995 Chien
6,256,814 B1 7/2001 Drobinski
6,349,434 B1 2/2002 Zhuang
6,473,919 B1 * 11/2002 Wang ..... 5/99.1
6,510,569 B1 * 1/2003 Hu ..... 5/99.1
6,568,004 B1 * 5/2003 Sun ..... 5/99.1
6,665,895 B1 12/2003 St. Pierre et al.
6,711,760 B1 * 3/2004 Yang ..... 5/99.1
6,725,475 B1 * 4/2004 Chen ..... 5/98.1
2003/0061657 A1 * 4/2003 Longenecker et al. ..... 5/99.1

* cited by examiner

*Primary Examiner* — Michael Trettel
(74) *Attorney, Agent, or Firm* — Winston Hsu; Scott Margo

(57) ABSTRACT

A playpen hub assembly includes a base, a first support part and a second support part. The first support part and the second support part are pivoted to two sides of a base body of the base respectively. A slider in the base is moved between a lock position and a release position along a first rail in the base body. An end of the slider has a first block structure for constraining rotation of the first support part relative to the base body. Another end of the slider has a second block structure for constraining rotation of the second support part relative to the base body. A driving part in the base is used for moving the slider to the release position. When the slider is located at the lock position, the first rail is substantially parallel to the first support part and the second support part.

25 Claims, 31 Drawing Sheets

PLAYPEN HUB ASSEMBLY

BACKGROUND OF THE INVENTION

1. Field of the Invention

The present invention relates to a hub assembly, and more specifically, to a playpen hub assembly.

2. Description of the Prior Art

In general, a hub assembly for a playpen comprises a base and a plurality of support pipes pivoted to the base in a radial manner. A lock device is commonly disposed on the base for avoiding erroneous playpen folding operations. In other words, when the playpen hub assembly is in an unfolded state, the lock device may constrain rotation of the plurality of support pipes relative to the base so that the plurality of support pipes and the base may provide steady support for objects placed on the playpen. On the other hand, when a user wants to fold up the playpen, the user just needs to lift the lock device upward to release restriction of the lock device for the plurality of support pipes so that the plurality of support pipes may rotate relative to the base accordingly. In such a manner, the user may fold the playpen up easily. A lateral engagement method and a vertical engagement method are commonly applied to structural designs of the said lock device. The lateral engagement method involves utilizing knife-shaped hooks to hook the plurality of support pipes laterally for constraining rotation of the plurality of support pipes relative to the base. However, this method usually requires a complicated structural design for assuring that each knife-shaped hook may hook a corresponding support pipe laterally. Furthermore, the vertical engagement method involves utilizing a hook formed on the base to vertically engage with a corresponding slot on one support pipe for constraining rotation of the support pipe relative to the base. That is to say, when the user wants to fold the playpen up, the user just needs to lift the hook of the base upward to release engagement of the hook and the slot so that the support pipe may rotate relative to the base accordingly. Thus, this method may allow the user to fold the playpen up easily and quickly. However, in playpen structural design, disposal of a two-step lock device in a playpen is necessary for safety concerns. In other words, for operational safety, the user needs to perform two release operations to fold up the playpen. Therefore, although the said vertical engagement method may allow the user to fold up the playpen easily and quickly, this method still has safety concerns in use, since this method only requires the user to perform one lifting operation to complete the playpen folding process.

SUMMARY OF THE INVENTION

The present invention provides a playpen hub assembly comprising a base having a base body, wherein a first rail is formed on the base and the base comprises a slider movably disposed in the first rail for moving between a lock position and a release position along the first rail; and a driving part connected to the slider, the driving part used for driving the slider to move to the release position along the first rail; a first support part pivoted to a side of the base; and a second support part pivoted to another side of the base; wherein one end of the slider has a first block structure for constraining rotation of the first support part relative to the base body, another end of the slider has a second block structure for constraining rotation of the second support part relative to the base body, and the driving part is used for releasing restriction of the first block structure for the first support part and restriction of the second block structure for the second support part; when the slider is located at the lock position, the first rail is substantially parallel to the first support part and the second support part.

The present invention further provides a playpen hub assembly comprising a base having a base body, wherein a first rail is formed on the base body, and the base comprises a slider movably disposed in the first rail for moving between a lock position and a release position along the first rail and a driving part connected to the slider; a first support part pivoted to a side of the base body; a second support part pivoted to another side of the base body, wherein one end of the slider has a first block structure for constraining rotation of the first support part relative to the base body, another end of the slider has a second block structure for constraining rotation of the second support part relative to the base body, and the driving part is used for driving the slider to move to the release position along the first rail so as to release restriction of the first block structure for the first support part and restriction of the second block structure for the second support part; and a pulling part connected to either one of the base body and the driving part, the pulling part used for driving the base body when the slider is moved to the release position so that the first support part and the second support part may rotate relative to the base body.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
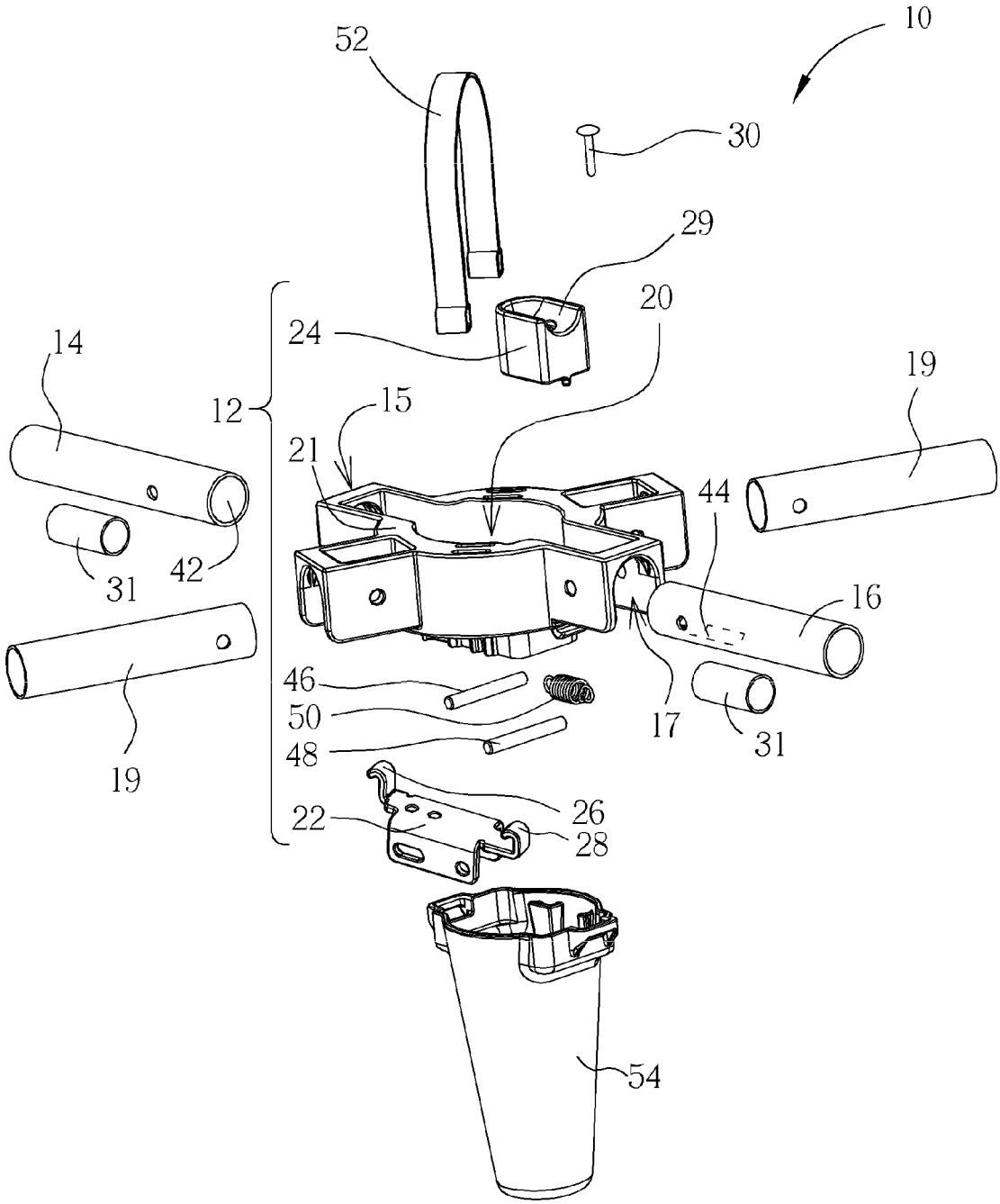
FIG. 1 is an exploded diagram of the playpen hub assembly according to the first embodiment of the present invention.
Figure 2:
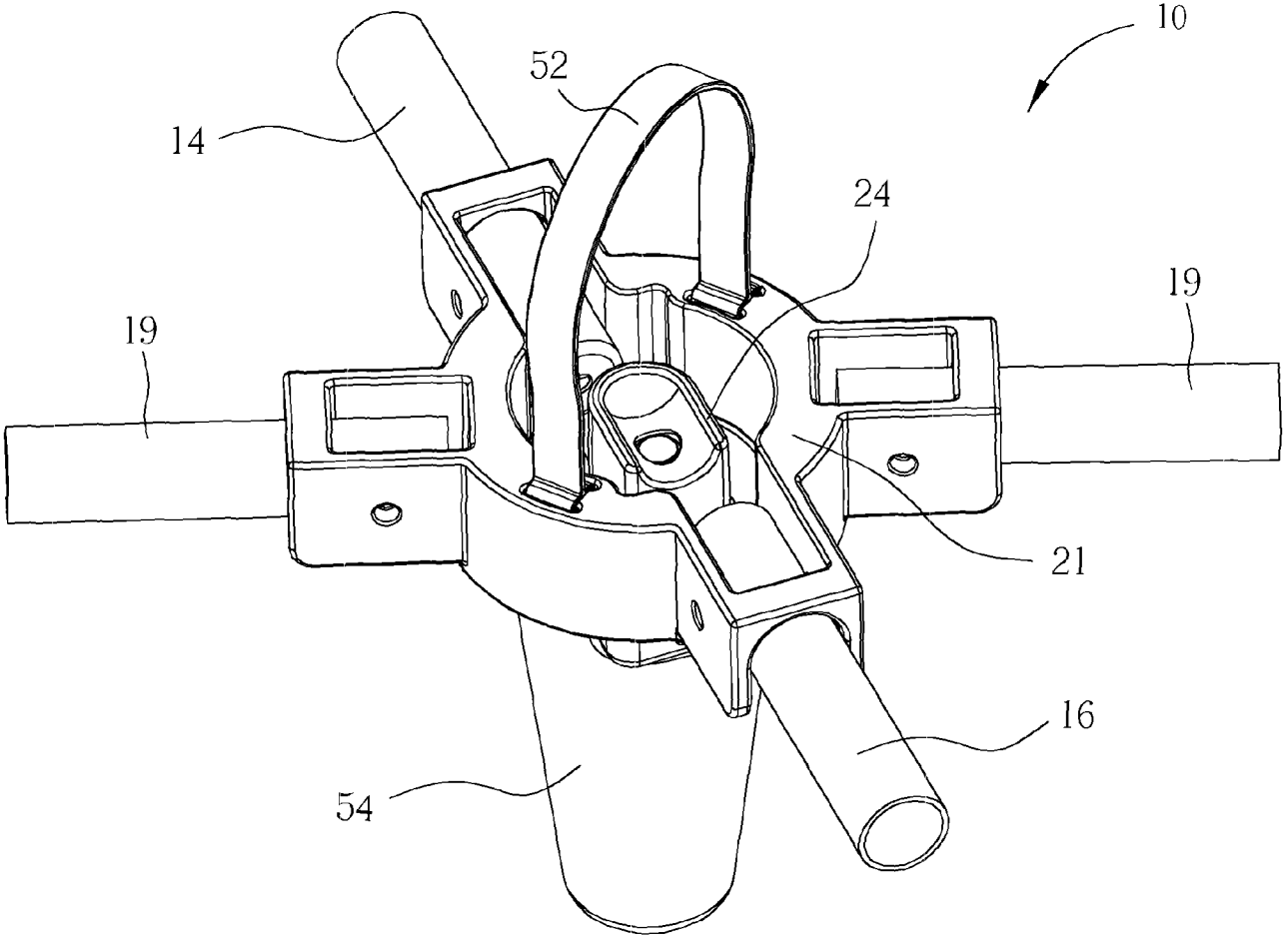
FIG. 2 is an assembly diagram of the playpen hub assembly in FIG. 1.
Figure 3:
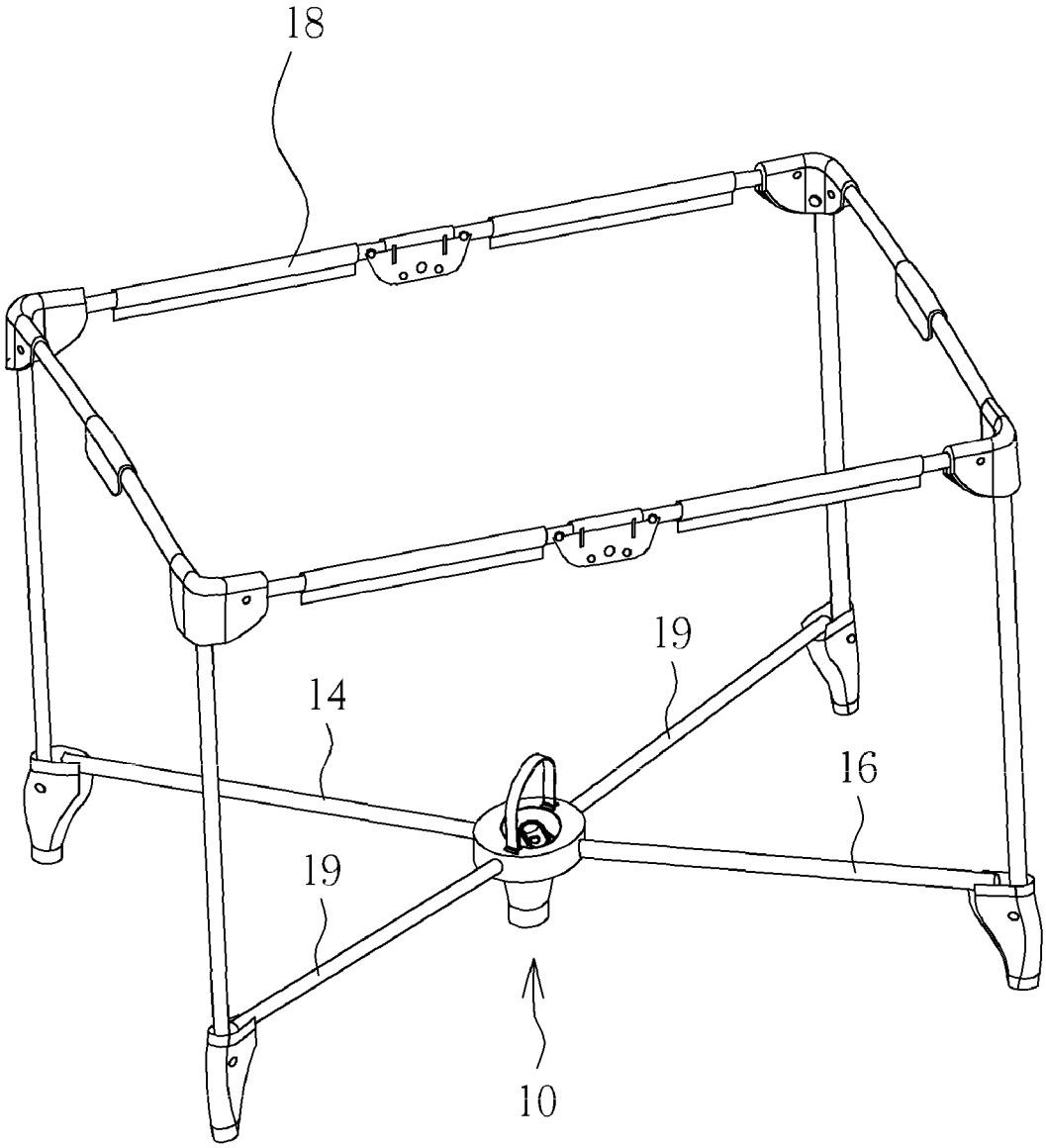
FIG. 3 is an assembly diagram of the playpen hub assembly in FIG. 2 and the playpen frame.

Please refer to FIG. 1 and FIG. 2. FIG. 1 is an exploded diagram of a playpen hub assembly 10 according to the first embodiment of the present invention. FIG. 2 is an assembly diagram of the playpen hub assembly 10. The playpen hub assembly 10 comprises a base 12, a first support part 14, and a second support part 16. The base 12 has a base body 21. Two ends of the base body 21 have a first pivot slot 15 and a second pivot slot 17 respectively. A first rail 20 formed in the base body 21 is accessible to the first pivot slot 15 and the second pivot slot 17. The first rail 20 is substantially parallel to the first support part 14 and the second support part 16 when the playpen hub assembly 10 is in a lock state. One end of the first support part 14 and one end of the second support part 16 are pivoted to the first pivot slot 15 and the second pivot slot 17 respectively. As shown in FIG. 2, both the first support part 14 and the second support part 16 are a pipe-shaped structure. In this embodiment, the playpen hub assembly 10 further comprises two support parts 19. The two support parts 19, the first support part 14, and the second support part 16 are pivoted to the base body 21 and a playpen frame 18 in a radial manner. Please refer to FIG. 3, which is an assembly diagram of the playpen hub assembly 10 in FIG. 2 and the playpen frame 18. As shown in FIG. 3, the playpen frame 18 may utilize the first support part 14, the second support part 16, and the two support parts 19, which are arranged in a radial manner, to provide a steady mechanism for holding objects when the playpen frame 18 is in an unfolded state. As mentioned above, four support parts are utilized in this embodiment. It should be mentioned that number of the support parts varies with different playpen structural designs. The base 12 comprises a slider 22 and a push button 24. The slider 22 is movably disposed in the first rail 20 of the base body 21, meaning that the slider 22 is capable of moving between a release position and a lock position along the first rail 20. The slider 22 has a first block structure 26 and a second block structure 28. The first block structure 26 is used for constraining rotation of the first support part 14 relative to the base body 21, and the second block structure 28 is used for constraining rotation of the second support part 16 relative to the base body 21. The push button 24 is connected to the slider 22 by a fixing part 30 in FIG. 1. The fixing part 30 may preferably be a rivet. A recessed portion 29 is formed on the push button 24 so that a user can push the push button 24 conveniently via the recessed portion 29. The push button 24 is used for pushing the slider 22 toward the release position to release the engagement of the first block structure 26 and the first support part 14 and the engagement of the second block structure 28 and the second support part 16, so that the first support part 14 and the second support part 16 may respectively rotate to a mutually parallel position relative to the base body 21. In another embodiment, the playpen hub assembly 10 may further comprise two reinforcing pipes 31 respectively disposed in the first support part 14 and the second support part 16. The first block structure 26 and the second block structure 28 may be engaged with the reinforced pipes 31 for reinforced engagement of the slider 22 with the first support part 14 and the second support part 16.

Figure 4:
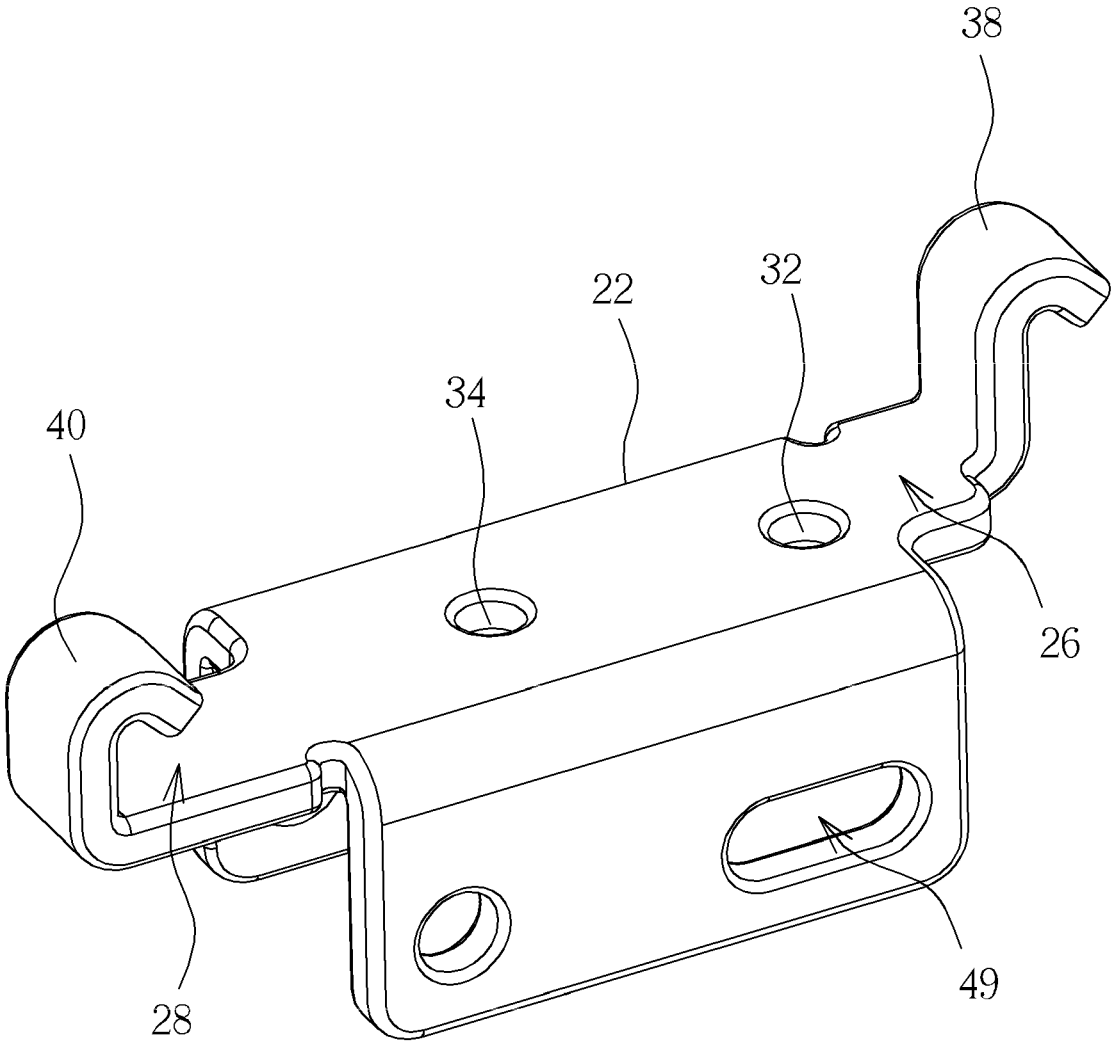
FIG. 4 is an enlarged diagram of the slider in FIG. 1.
Figure 5:
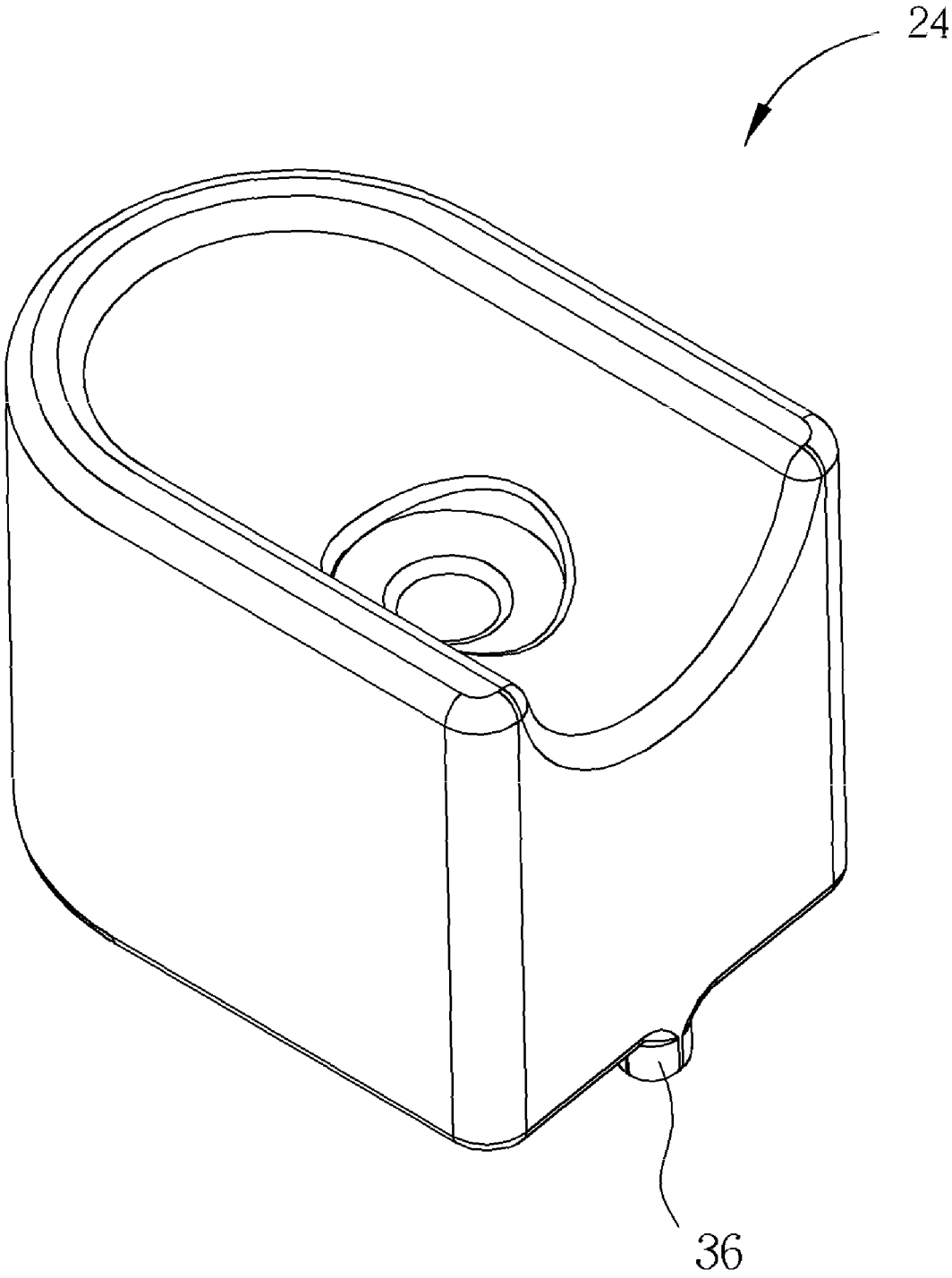
FIG. 5 is an enlarged diagram of the push button in FIG. 1.
Figure 6:
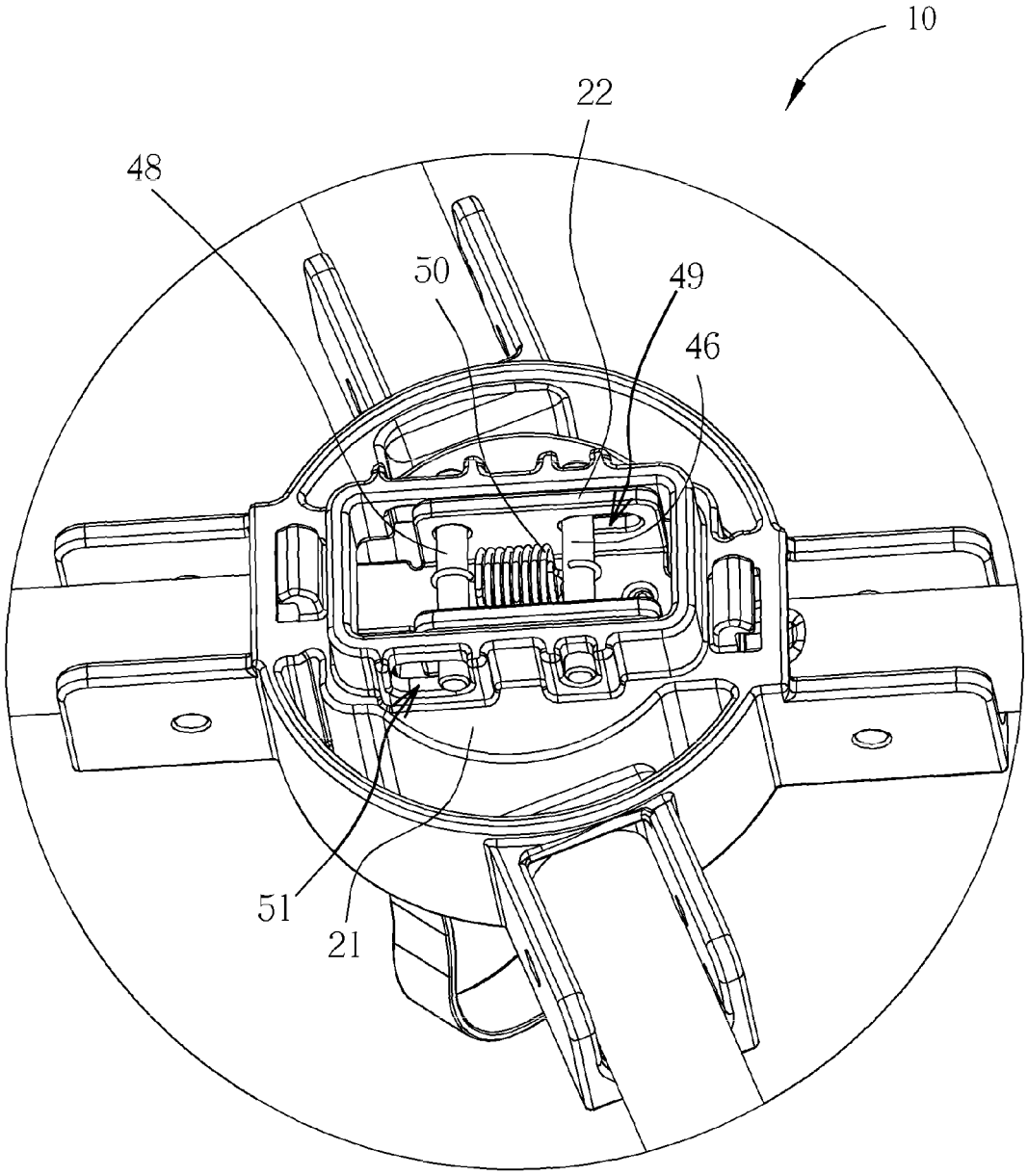
FIG. 6 is a bottom view of the playpen hub assembly in FIG. 1 without the support pillar.

In the following, more detailed description for connection of the slider 22, the push button 24, and the fixing part 30 is provided. Please refer to FIG. 4 and FIG. 5. FIG. 4 is an enlarged diagram of the slider 22 in FIG. 1. FIG. 5 is an enlarged diagram of the push button 24 in FIG. 1. As shown in FIG. 4 and FIG. 5, the slider 22 has a first positioning hole 32 and a second positioning hole 34, and the push button 24 has a protruding portion 36 corresponding to the first positioning hole 32. The protruding portion 36 of the push button 24 may be inserted into the first positioning hole 32. Thus, the push button 24 may be fixed to the slider 22 in a connection manner wherein the fixing part 30 is inserted into the second positioning hole 34 after passing through the push button 24, and the protruding portion 36 is inserted into the first positioning hole 32. Furthermore, as shown in FIG. 1 and FIG. 4, the first block structure 26 and the second block structure 28 have a first hook 38 and a second hook 40 respectively, and the first support part 14 and the second support part 16 have a first engaging hole 42 corresponding to the first hook 38 and a second engaging hole 44 corresponding to the second hook 40 respectively. In this embodiment, the first engaging hole 42 is a pipe hole of the first support part 14, and the second engaging hole 44 is a slot formed on the pipe wall of the second support part 16. The first hook 38 and the second hook 40 are used for engaging with the first engaging hole 42 and the second engaging hole 44, respectively, so as to constrain rotation of the first support part 14 and the second support part 16 relative to the base body 21. Next, please refer to FIG. 6, which is a bottom view of the assembled playpen hub assembly 10 in FIG. 1. As shown in FIG. 6, the base 12 further comprises a first connecting rod 46, a second connecting rod 48, and an elastic part 50. The first connecting rod 46 is fixed to the base body 21 and is disposed through first guide slots 49 respectively located at two sides of the slider 22, so that the slider 22 may move relative to the first connecting rod 46. The second connecting rod 48 is fixed to the slider 22 and is movably disposed through second guide slots 51 respectively located at two sides of the base body 21, so that the second connecting rod 48 and the slider 22 may move together relative to the base body 21. The elastic part 50 is connected to the first connecting rod 46 and the second connecting rod 48. As shown in FIG. 6, the elastic part 50 may preferably be a spring. The elastic part 50 is used for providing the slider 22 with elastic restoring force when the slider 22 moves relative to the base body 21. It should be mentioned that a connection design for the elastic part 50, the slider 22, and the base body 21 may be not limited to the said method. For example, the elastic part 50 may also be connected to the slider 22 and the base body 21 directly. Furthermore, as shown in FIG. 1, the playpen hub assembly 10 further comprises a pulling part 52 and a support pillar 54. The pulling part 52 is installed on the base body 21 so that the user may grasp the pulling part 52 to pull the base 21 upward. The pulling part 52 may be a webbing strap. The support pillar 54 is installed under the base 12 for providing the base 12 with a vertical support force.

Figure 7:
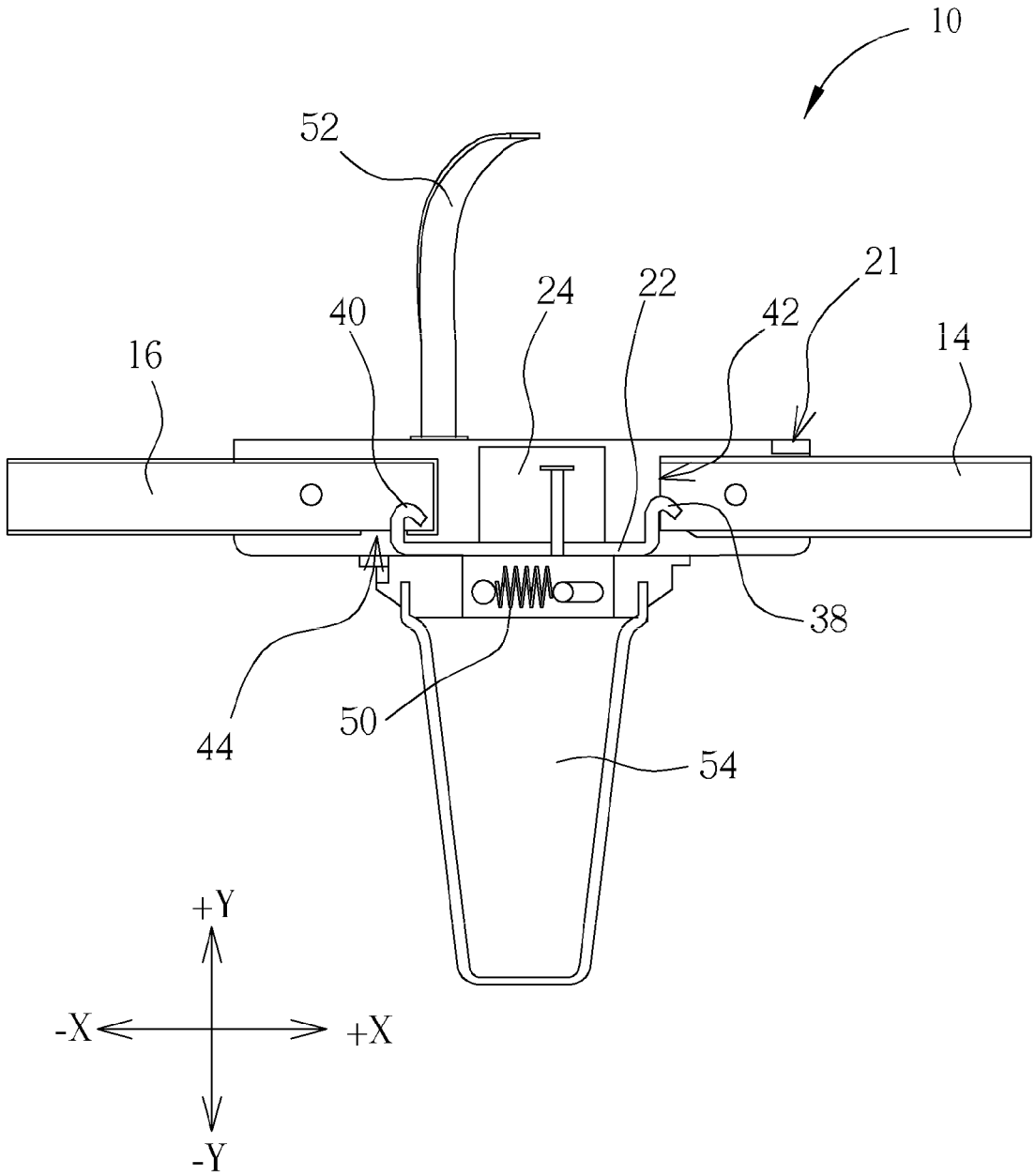
FIG. 7 is a cross-sectional diagram of the playpen hub assembly in FIG. 1 being in a lock state.
Figure 8:
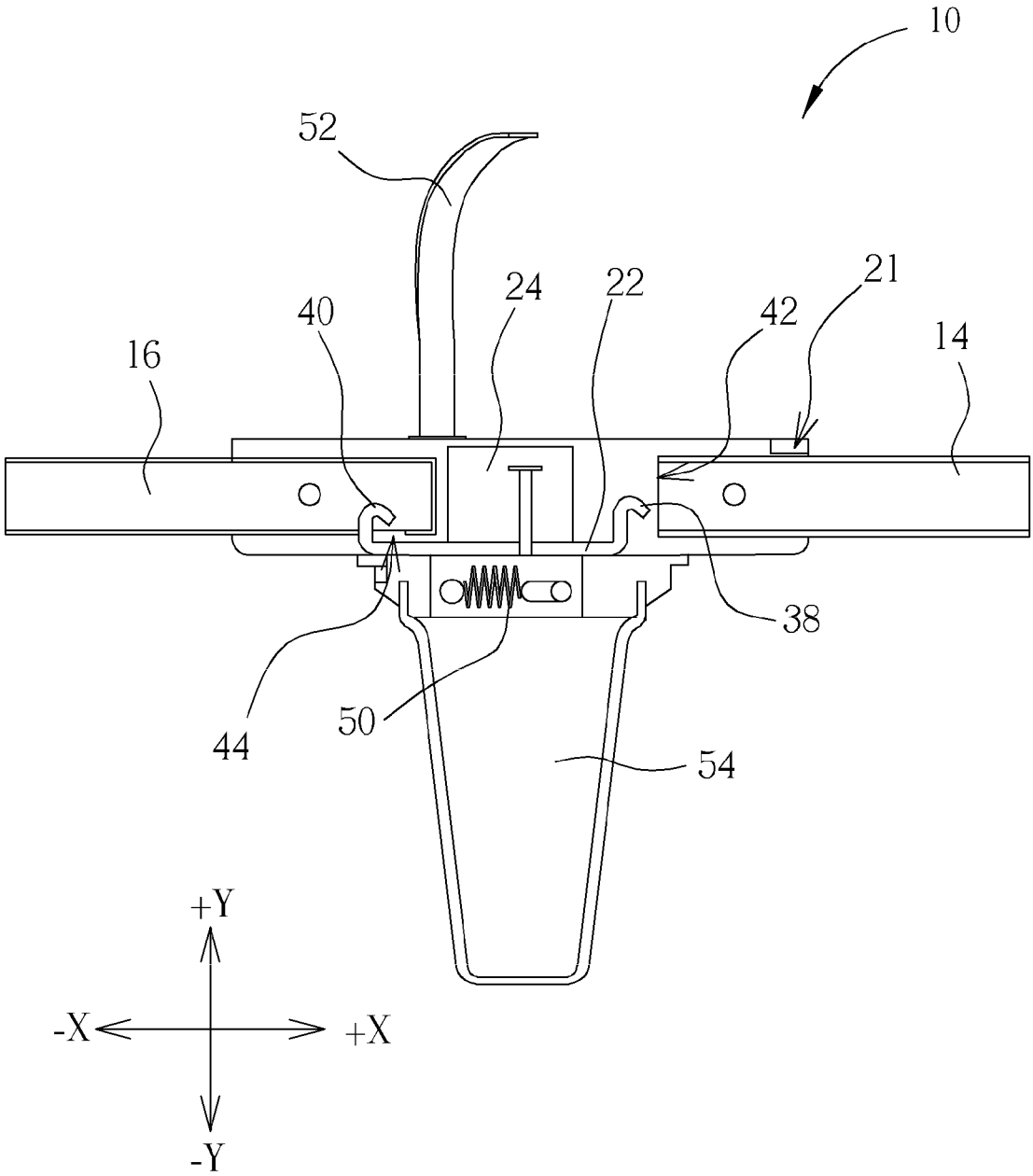
FIG.8 is a cross-sectional diagram of the playpen hub assembly in FIG. 1 being in a release state

More detailed description for the playpen hub assembly 10 is provided as follows. Please refer to FIG. 7 and FIG. 8. FIG. 7 is a cross-sectional diagram of the playpen hub assembly 10 in FIG. 2 in a lock state. FIG. 8 is a cross-sectional diagram of the playpen hub assembly 10 in FIG. 2 in a release state. As shown in FIG. 7, when the playpen hub assembly 10 is in the lock state, the slider 22 is located at the lock position, and the first hook 38 and the second hook 40 are engaged with the first engaging hole 42 and the second engaging hole 44 respectively for constraining rotation of the first support part 14 and the second support part 16 relative to the base body 21. At this time, the playpen frame 18 is in the unfolded state (as shown in FIG. 3), and the first support part 14, the second support part 16, and two support parts 19 support the base 12 with the support pillar 54 cooperatively. On the other hand, when the user wants to fold the playpen frame 18 up, the user just needs to use his finger to push the push button 24 toward a −X-axis direction as shown in FIG. 7 along the first rail 20. At this time, the slider 22 may also be moved toward the −X-axis direction (the elastic part 50 is in an extended state) with the first hook 38 and the second hook 40 thereon, since the push button 24 is fixed to the slider 22. After the first hook 38 and the second hook 40 are no longer engaged with the first engaging hole 42 of the first support part 14 and the second engaging hole 42 of the second support part 16 respectively, meaning that the slider 22 has moved to the release position as shown in FIG. 8, the user then needs to pull the pulling part 52 toward a direction perpendicular to the first rail 20 (i.e. a +Y-axis direction as shown in FIG. 8), so that the first support part 14 and the second support part 16 may start to rotate relative to the base body 21 accordingly. After the first support part 14 and the second support part 16 rotate to a mutually parallel position, the playpen frame 18 may be in a folded state. Subsequently, the slider 22 may be moved back to the lock position as shown in FIG. 7 accordingly by elastic restoring force provided from the elastic part 50. Similarly, if the user wants to unfold the playpen frame 18 again, the user just needs to push the base 12 of the playpen hub assembly 10 toward a -Y-axis direction, at which point the first support part 14 and the second support part 16 may rotate relative to the base body 21. After the first support part 14 and the second support part 16 rotate a specific angle relative to the base body 21, the first support part 14 and the second support part 16 may abut against the first hook 38 and the second hook 40 respectively. Subsequently, since both the first hook 38 and the second hook 40 have an inclined surface, the first support part 14 and the second support part 16 may respectively push the first hook 38 and the second hook 40 toward the −X-axis direction along the said inclined surfaces. As a result, the slider 22 may be pushed toward the −X-axis direction by the first support part 14 and the second support part 16 (at this time, the elastic part 50 is in an extended state). After the first support part 14 and the second support part 16 rotate to the mutually parallel position as shown in FIG. 8 relative to the base body 21, the slider 22 may be moved back to the lock position as shown in FIG. 7 by elastic restoring force provided from the elastic part 50. At the same time, the first hook 38 and the second hook 40 may respectively be engaged with the first engaging hole 42 of the first support part 14 and the second engaging hole 44 of the second support part 16 again. Thus, since both the first support part 14 and the second support part 16 can not rotate relative to the base body 21 due to the engagement of the first hook 38 and the first engaging hole 42 and the engagement of the second hook 40 and the first engaging hole 44, the playpen hub assembly 10 is in the lock state for further use.

Figure 9:
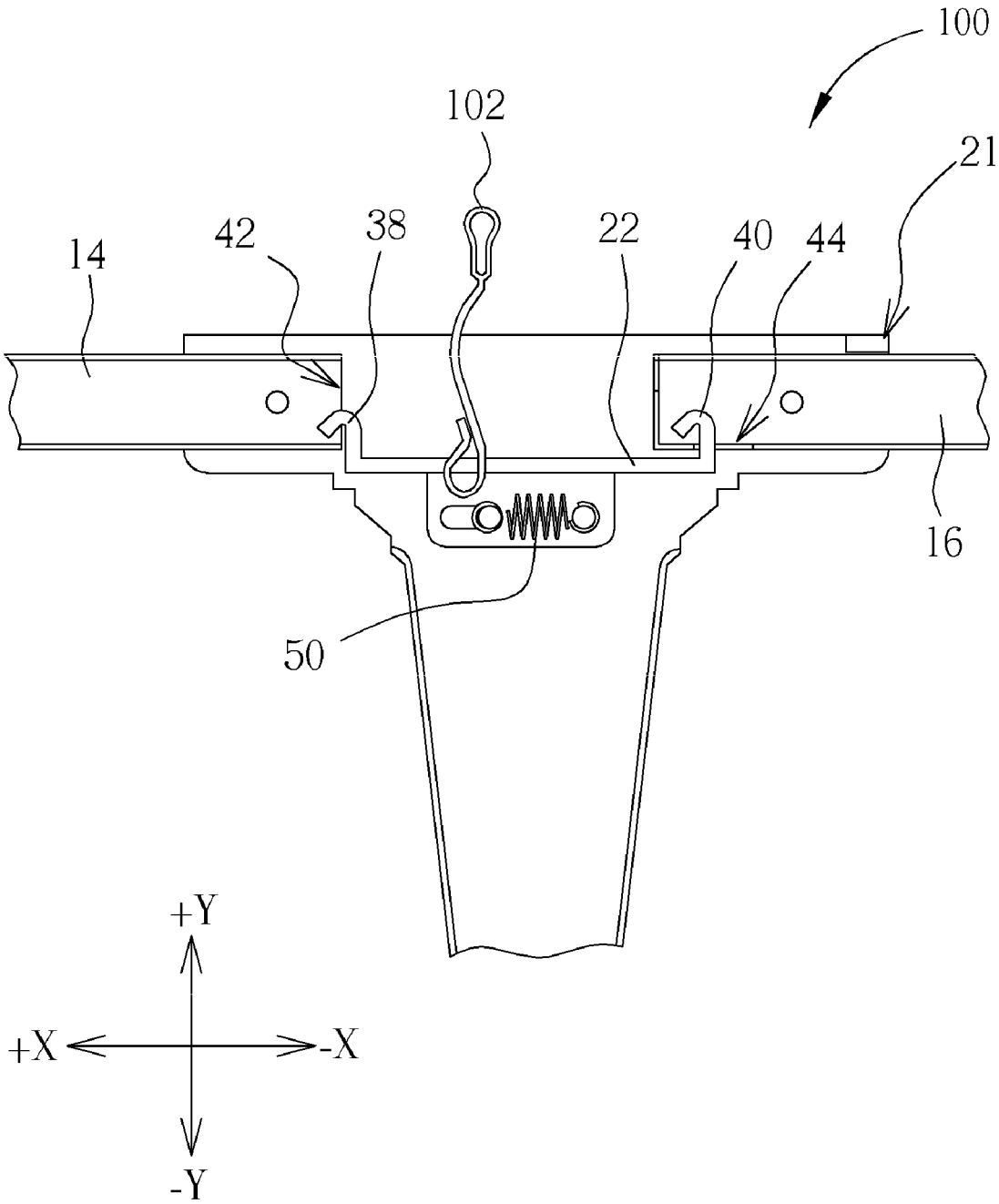
FIG. 9 is a cross-sectional diagram of the playpen hub assembly being in a lock state according to the second embodiment of the present invention.
Figure 10:
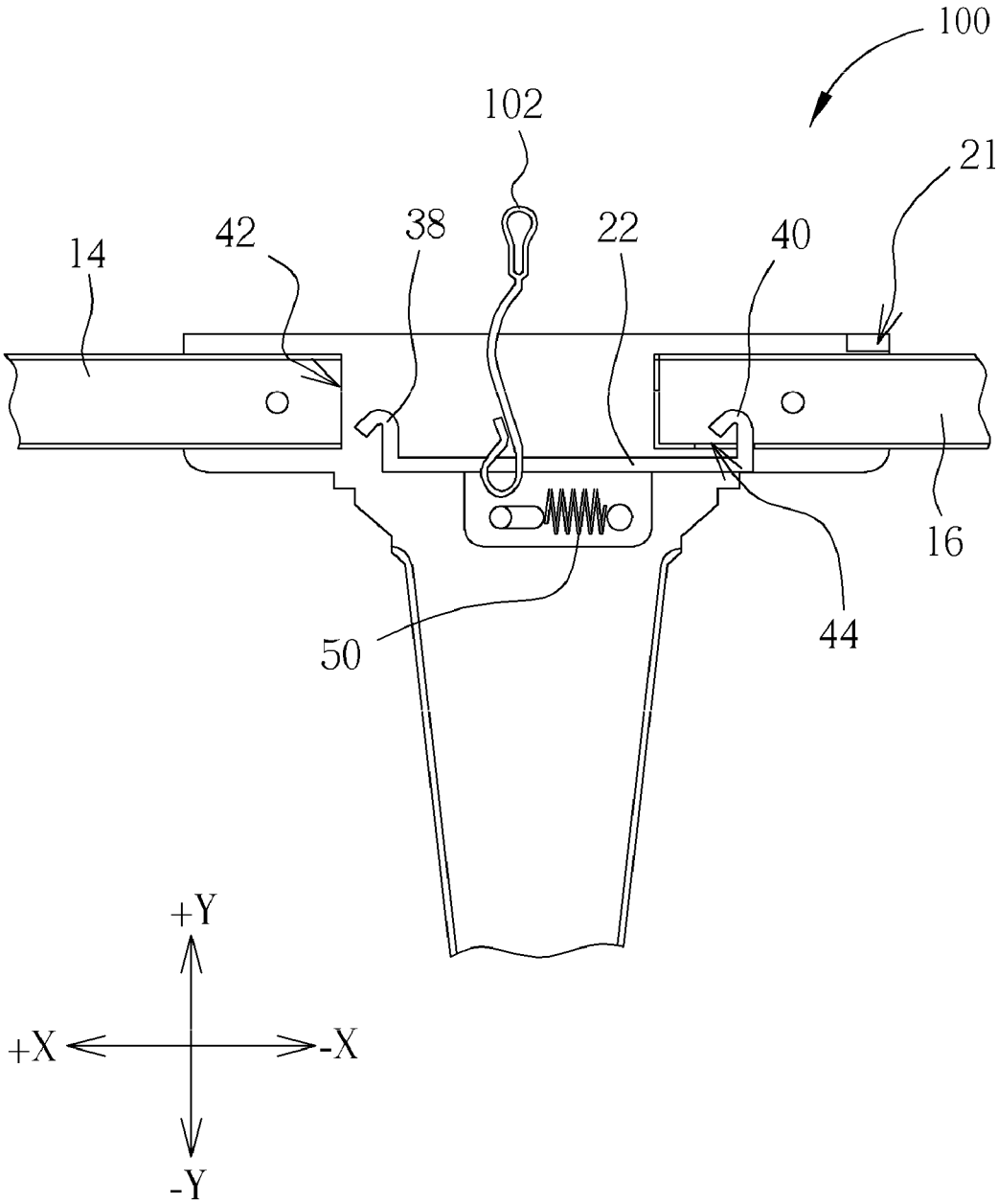
FIG. 10 is a cross-sectional diagram of the playpen hub assembly in FIG. 9 being in a release state.

Next, please refer to FIG. 9, which is a cross-sectional diagram of a playpen hub assembly 100 being in a lock state according to the second embodiment of the present invention. Components, functions, and positions both mentioned in the first embodiment and the second embodiment represent similar components, functions, and positions, and the related description is therefore omitted herein. A difference between the playpen hub assembly 100 and the playpen hub assembly 10 of the first embodiment is the structural design of the driving part. The driving part mentioned in the first embodiment is a push button, and the driving part mentioned in the second embodiment is a flexible driving part (i.e. a webbing strap 102). The webbing strap 102 is fixed to the slider 22. In the following, more detailed description for the playpen hub assembly 100 is provided. When the user wants to fold the playpen frame 18 up, the user needs to pull the webbing strap 102 to move the slider 22 toward the −X-axis direction (at this time, the elastic part 50 is in an extended state). At the same time, the first hook 38 and the second hook 40 on the slider 22 may also move toward the −X-axis direction. After the first hook 38 and the second hook 40 are no longer engaged with the first engaging hole 42 and the second engaging hole 44 respectively, meaning that the slider 22 has moved from the lock position as shown in FIG. 9 to the release position as shown in FIG. 10, the user then needs to pull the webbing strap 102 toward the +Y-axis direction so that the first support part 14 and the second support part 16 may start to rotate relative to the base body 21 accordingly. As a result, the playpen frame 18 may be folded up, at which point the slider 22 may be moved back to the lock position as shown in FIG. 9 by elastic restoring force provided from the elastic part 50. Similarly, if the user wants to unfold the playpen frame 18 again, the user just needs to push the base 12 of the playpen hub assembly 100 toward the −Y-axis direction so that the first support part 14 and the second support part 16 may start to rotate relative to the base body 21 accordingly. When the first support part 14 and the second support part 16 rotate a specific angle relative to the base body 21, the first support part 14 and the support part 16 may respectively abut against the first hook 38 and the second hook 40. Subsequently, since both the first hook 38 and the second hook 40 have an inclined surface, the first support part 14 and the second support part 16 may respectively push the first hook 38 and the second hook 40 toward the −X-axis direction along the said inclined surfaces. That is to say, the slider 22 may be moved toward the −X-axis direction due to pushing of the first support part 14 and the second support part 16 (at this time, the elastic part 50 is in an extended state). After the first support part 14 and the second support part 16 rotate to a mutually parallel position as shown in FIG. 10, the slider 22 may be moved back to the lock position as shown in FIG. 9 in the +X-axis direction by elastic restoring force provided from the elastic part 50, at which point the first hook 38 and the second hook 40 may respectively be engaged with the first engaging hole 42 of the first support part 14 and the second engaging hole 44 of the second support part 16 again. In such a manner, the first support part 14 and the second support part 16 cannot rotate relative to the base body 21 due to the engagement of the first support part 14 and the first engaging hole 42 and the engagement of the second engaging part 16 and the second engaging hole 44. As a result, the playpen hub assembly 100 is in the lock state correspondingly for further use.

Figure 11:
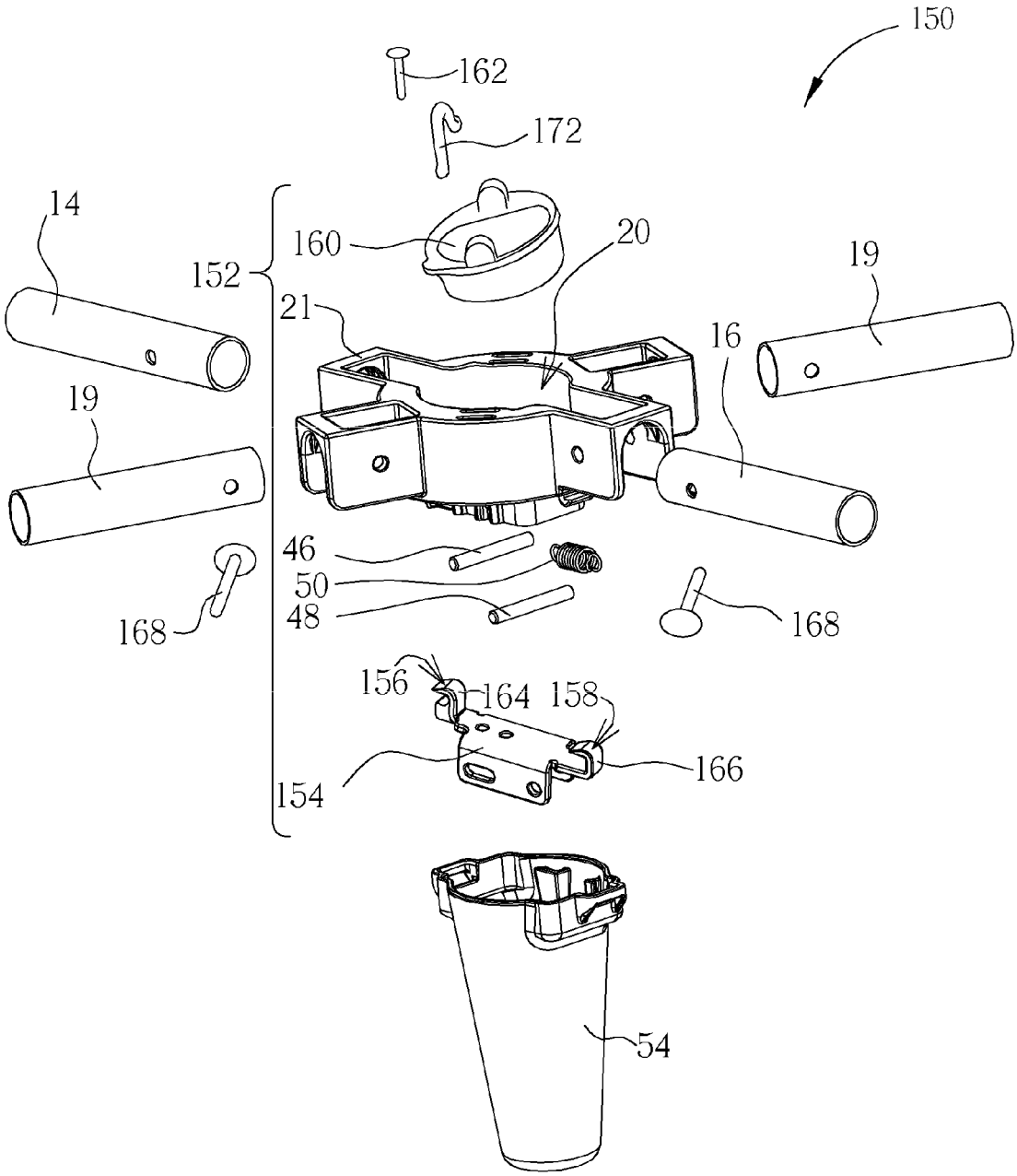
FIG. 11 is an exploded diagram of the playpen hub assembly according to the third embodiment of the present invention.
Figure 12:
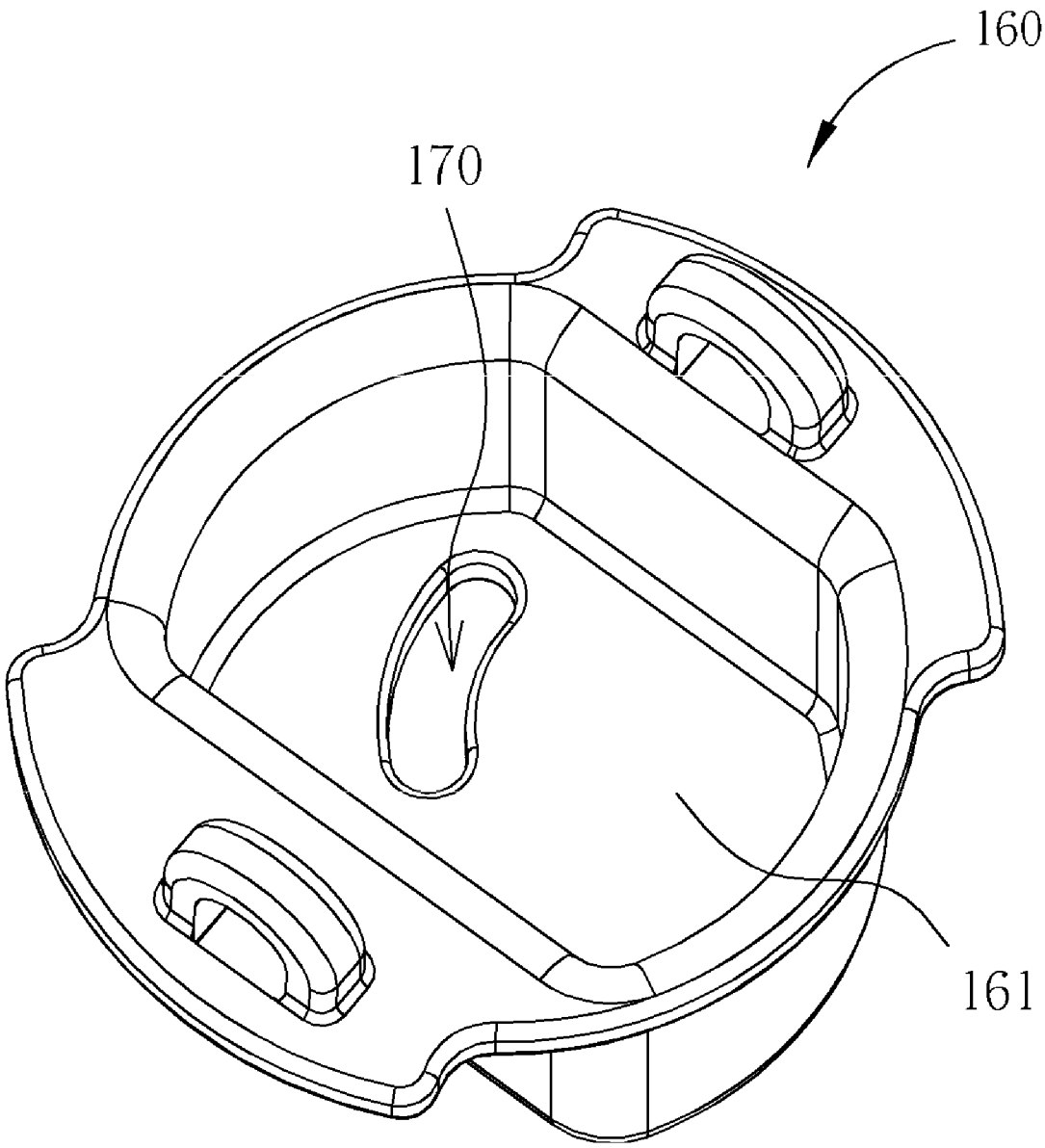
FIG. 12 is an enlarged diagram of the knob in FIG. 11.

Next, please refer to FIG. 11, which is an exploded diagram of a playpen hub assembly 150 according to the third embodiment of the present invention. Components, functions, positions both mentioned in the third embodiment and the first embodiment represent similar components, functions, and positions, and the related description is therefore omitted herein. Differences between the playpen hub assembly 150 and the playpen hub assembly 10 of the first embodiment are the structural design of the driving part and the engagement method of the support part and the block structure. The playpen hub assembly 150 comprises a base 152, the first support part 14, and the second support part 16. The base 152 comprises a slider 154 and a knob 160. The slider 154 is movably disposed in the base body 21 and the first rail 20, meaning that the slider 154 may be able to move between a release position and a lock position along the first rail 20. Two ends of the slider 154 have a first block structure 156 and a second block structure 158 respectively. The first block structure 156 is used for constraining rotation of the first support part 14 relative to the base body 21, and the second block structure 158 is used for constraining rotation of the second support part 16 relative to the base body 21. The first block structure 156 and the second block structure 158 have a first hook 164 and a second hook 166 respectively. The first support part 14 comprises a protruding part 168 corresponding to the first hook 164, and the second support part 16 comprises a protruding part 168 corresponding to the second hook 166. In this embodiment, the said protruding parts 168 may preferably be T-shaped rivets or common pins. The first hook 164 and the second hook 166 are used respectively for engaging with the protruding part 168 on the first support part 14 and the protruding part 168 on the second support part 16. The knob 160 is used for pushing the slider 154 to release the first support part 14 and the second support part 16 so that the first support part 14 and the second support part 16 may rotate relative to the base body 21. Next, please refer to FIG. 12, which is an enlarged diagram of the knob 160 in FIG. 11. As shown in FIG. 12, the knob 160 comprises a main body 161, on which a second rail 170 (i.e. an arc-shaped rail) is formed, and a grip 172 as shown in FIG. 11. The fixing part 162 as shown in FIG. 11 is disposed through the second rail 170 and is fixed to the slider 154. When the knob 160 rotates relative to the base body 21, the fixing part 162 is moved correspondingly along the second rail 170 so as to move the first hook 164 and the second hook 166 on the slider 154 along the first rail 20 of the base body 21. Furthermore, the grip 172 is fixed to the main body 161 for convenience of use.

Figure 13:
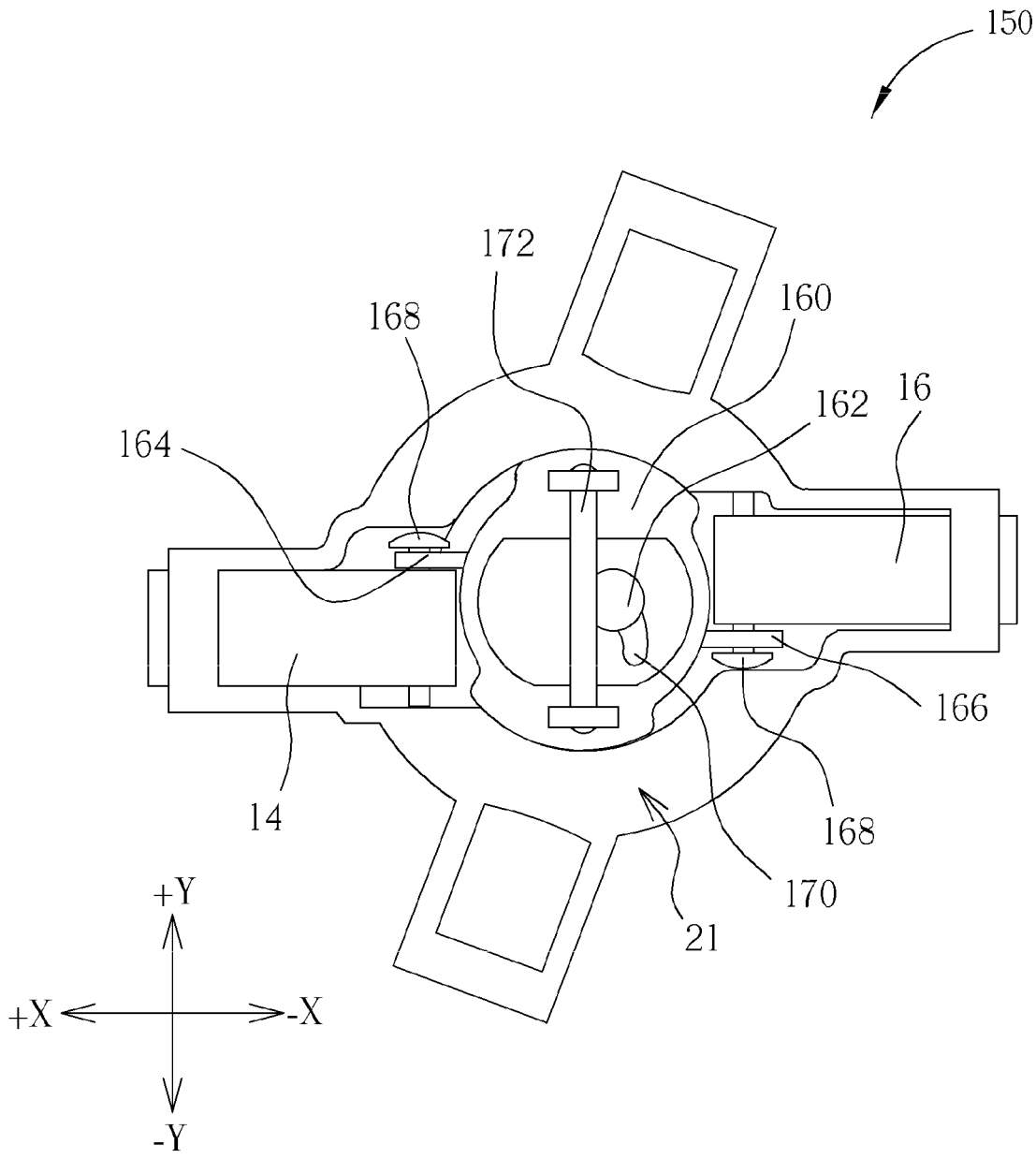
FIG. 13 is a top view of the playpen hub assembly in FIG. 11 being in a lock state.
Figure 14:
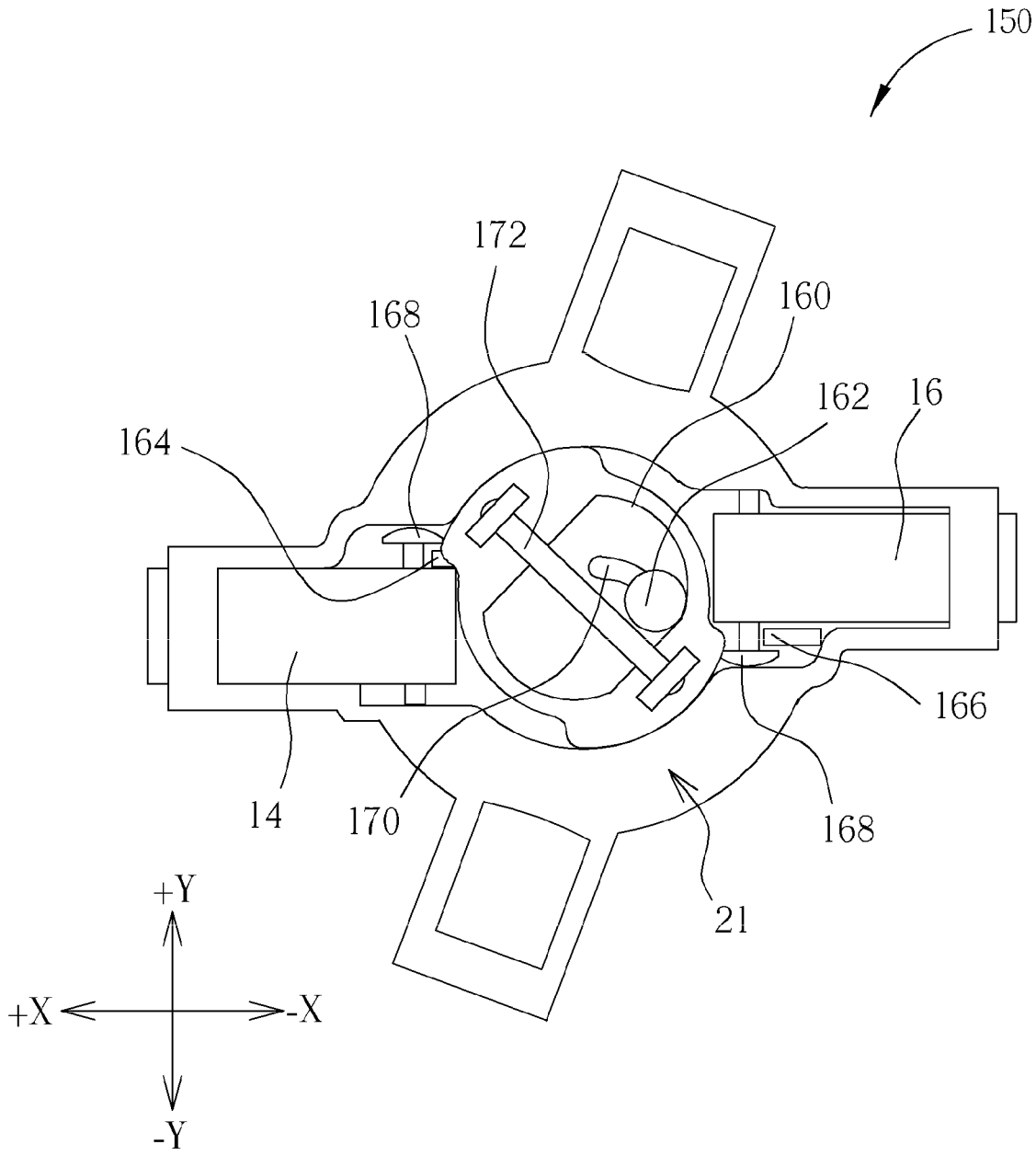
FIG. 14 is a top view of the playpen hub assembly in FIG. 11 being in a release state.

More detailed description for the playpen hub assembly 150 is provided as follows. Please refer to FIG. 13 and FIG. 14. FIG. 13 is a top view of the playpen hub assembly 150 in FIG. 9 being in a release state. FIG. 14 is a top view of the playpen hub assembly 150 in FIG. 9 being in a lock state. When the playpen hub assembly 150 is in the lock state, as shown in FIG. 13, the first hook 164 and the second hook 166 engage with the protruding part 168 on the first support part 14 and the protruding part 168 on the second support part 16 respectively for constraining rotation of the first support part 14 and the second support part 16 relative to the base body 21. On the other hand, when the user wants to fold the playpen frame 18 up, the user needs to grasp the grip 172 to rotate the knob 160 counterclockwise from the position as shown in FIG. 13 to the position as shown in FIG. 14 relative to the base body 21. At the same time, since the fixing part 162 is disposed through the second rail 170 and is fixed to the slider 154, the fixing part 162 may move along the second rail 170 with rotation of the knob 160. Thus, the slider 154 may be moved toward the −X-axis direction by the fixing part 162 (at this time, the elastic part 50 is in an extended state) so as to drive the first hook 164 and the second hook 166 to move toward the −X-axis direction correspondingly. After the first hook 164 and the second hook 166 are no longer engaged with the protruding part 168 on the first support part 14 and the protruding part 168 on the second support part 16 respectively, meaning that the slider 154 has moved to the release position as shown in FIG. 14, the user then needs to pull the grip 172 to lift the base 152 upward so that the first support part 14 and the second support part 16 may start to rotate relative to the base body 21. In such a manner, the playpen frame 18 may be folded up accordingly. Subsequently, the slider 154 may be moved back to the lock position as shown in FIG. 13 by elastic restoring force provided by the elastic part 50. Similarly, if the user wants to unfold the playpen frame 18 again, the user just needs to press the base 152 downward so that the first support part 14 and the second support part 16 may rotate relative to the base body 21 accordingly. After the first support part 14 and the second support part 16 rotate a specific angle relative to the base body 21, the protruding part 168 on the first support part 14 and the protruding part 168 on the second support part 16 may abut against the first hook 164 and the second hook 166 respectively. Subsequently, since both the first hook 164 and the second hook 166 have an inclined surface structure, the protruding part 168 on the first support part 14 and the protruding part 168 on the second support part 16 may respectively push the first hook 164 and the second hook 166 to move toward the −X-axis direction along the said inclined surfaces. In other words, the protruding parts 168 may push the slider 154 toward the −X-axis direction (at this time, the elastic part 50 is in an extended state). After the first support part 14 and the second support part 16 rotate to a mutually parallel position as shown in FIG. 14 relative to the base body 21, the slider 154 may be moved to the lock position as shown in FIG. 13 along the +X-axis direction by elastic restoring force provided from the elastic part 50, at which point the first hook 164 and the second hook 166 may be engaged with the protruding part 168 on the first support part 14 and the protruding part 168 on the second support part 16 again. In such a manner, both the first support part 14 and the second support part 16 cannot rotate relative to the base body 21 due to the said engagement of the first hook 164, the second hook 166, and the protruding parts 168. As a result, the playpen hub assembly 150 may be in the lock state for further use. Furthermore, it should be noted that the engagement design of the hook and the protruding part mentioned in the third embodiment may also be applied to the first and second embodiments.

Figure 15:
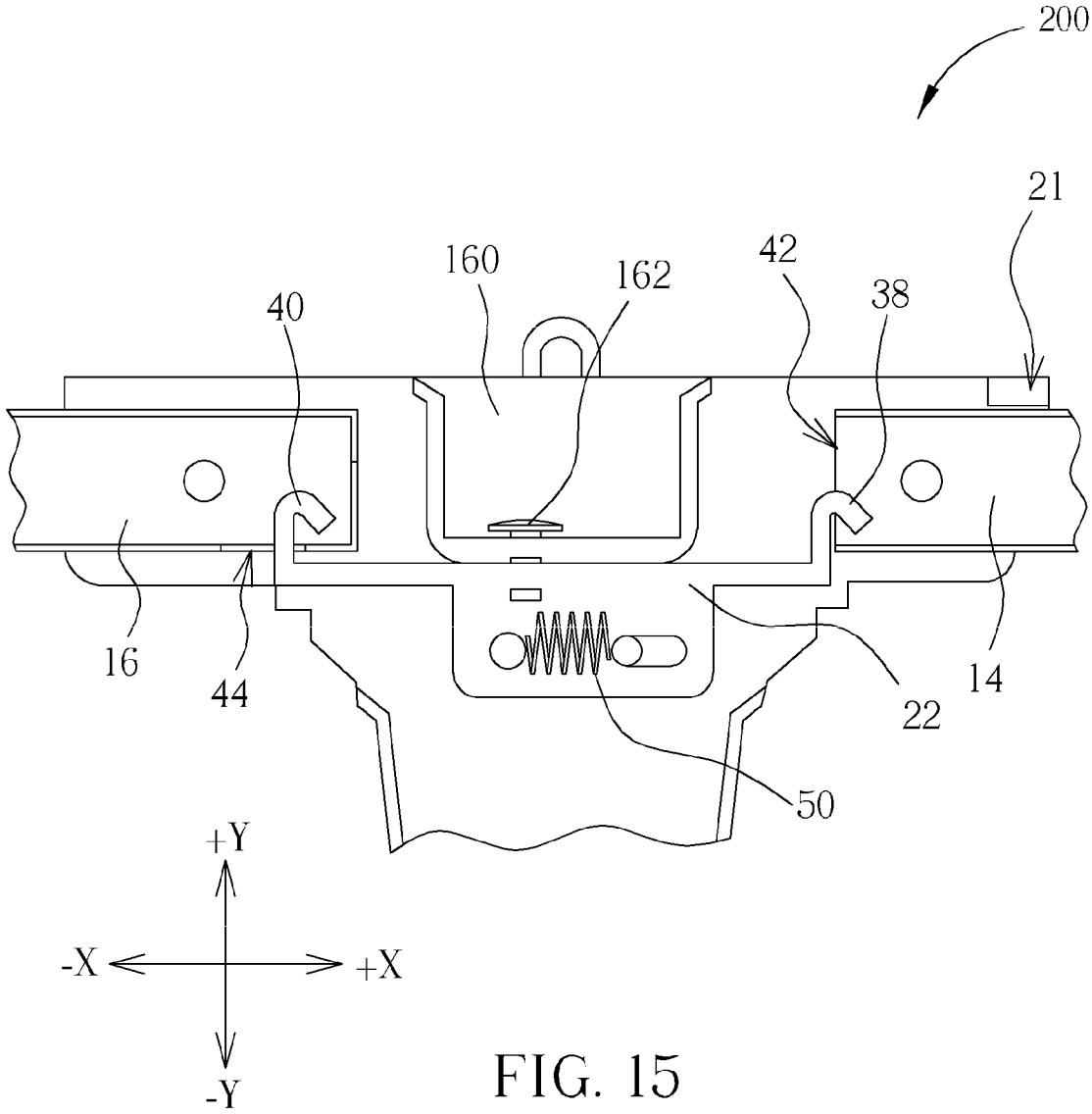
FIG. 15 is a cross-sectional diagram of the playpen hub assembly being in a lock state according to the fourth embodiment of the present invention.

Next, please refer to FIG. 15, which is a cross-sectional diagram of a playpen hub assembly 200 in a lock state according to the fourth embodiment of the present invention. Components, functions, positions, and the related description mentioned in the fourth embodiment similar to those in the said embodiments are omitted herein. A difference between the playpen hub assembly 200 and the playpen hub assembly 150 in the third embodiment is the engagement design of the support part and the block structure. In the third embodiment, the first hook 164 and the second hook 166 are utilized for engaging with the protruding part 168 on the first support part 14 and the protruding part 168 on the second support part 16 respectively, so that rotation of the first support part 14 and the second support part 16 relative to the base body 21 may be constrained. In the fourth embodiment, the first hook 38 and the second hook 40 are utilized for engaging with the first engaging hole 42 and the second engaging hole 44 for the same purpose of constraining rotation of the first support part 14 and the second support part 16 relative to the base body 21 mentioned in the third embodiment. As for the related description of other parts mentioned in the fourth embodiment, it is the same as that mentioned in the third embodiment and is therefore omitted herein.

Figure 16:
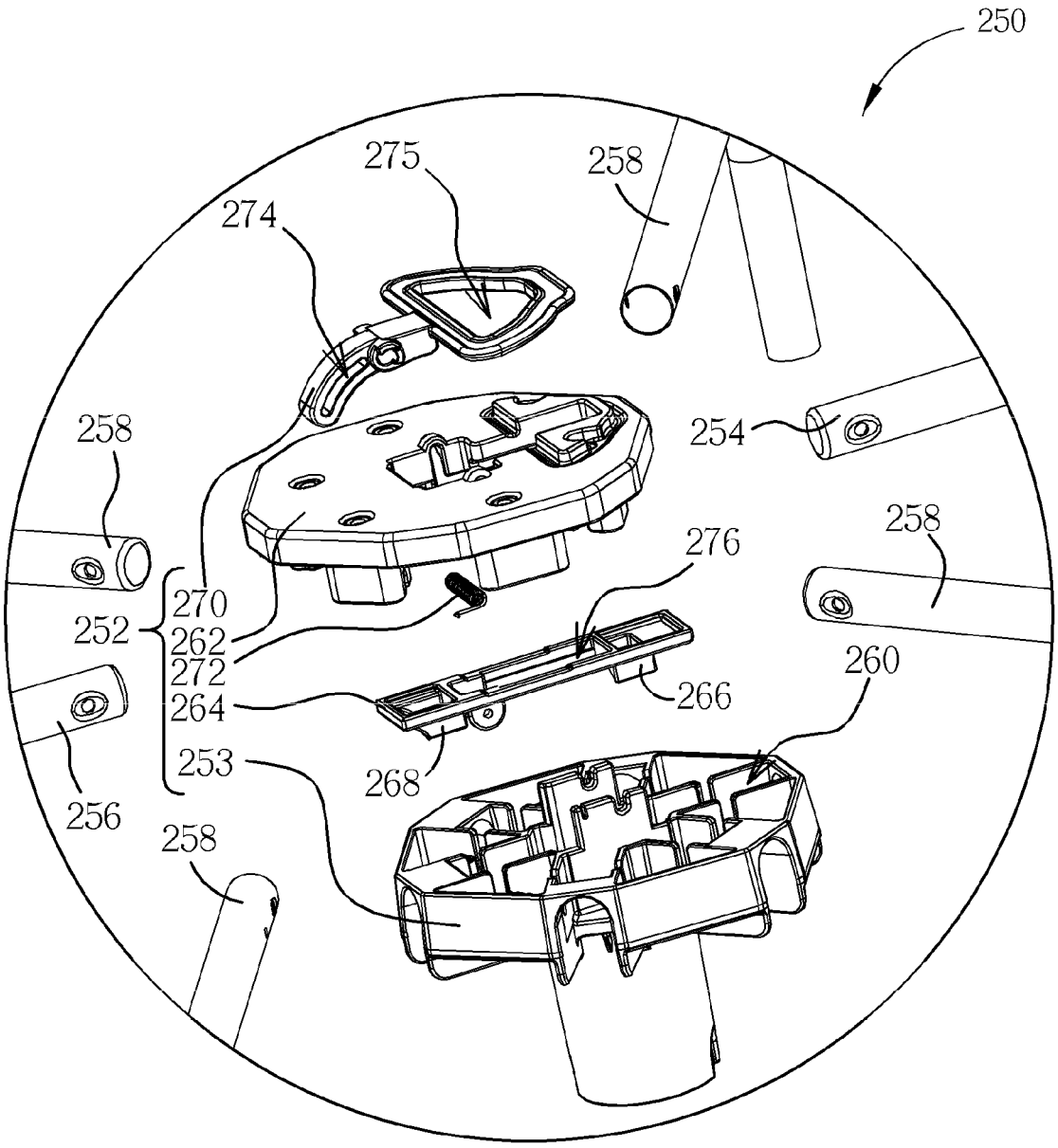
FIG. 16 is an exploded diagram of the playpen hub assembly according to the fifth embodiment of the present invention.
Figure 17:
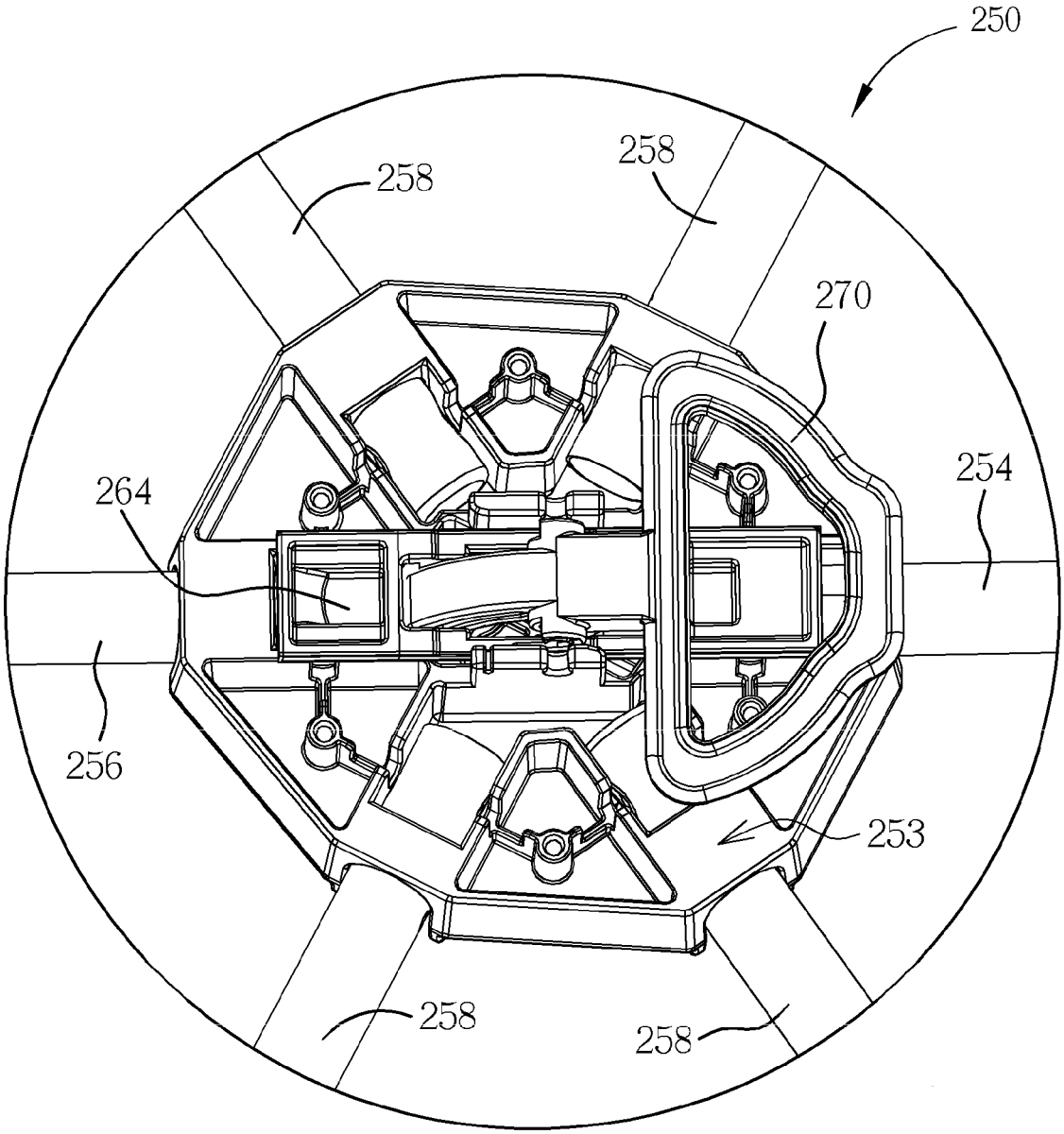
FIG. 17 is an assembly diagram of the playpen hub assembly in FIG. 16 without the upper lid.
Figure 18:
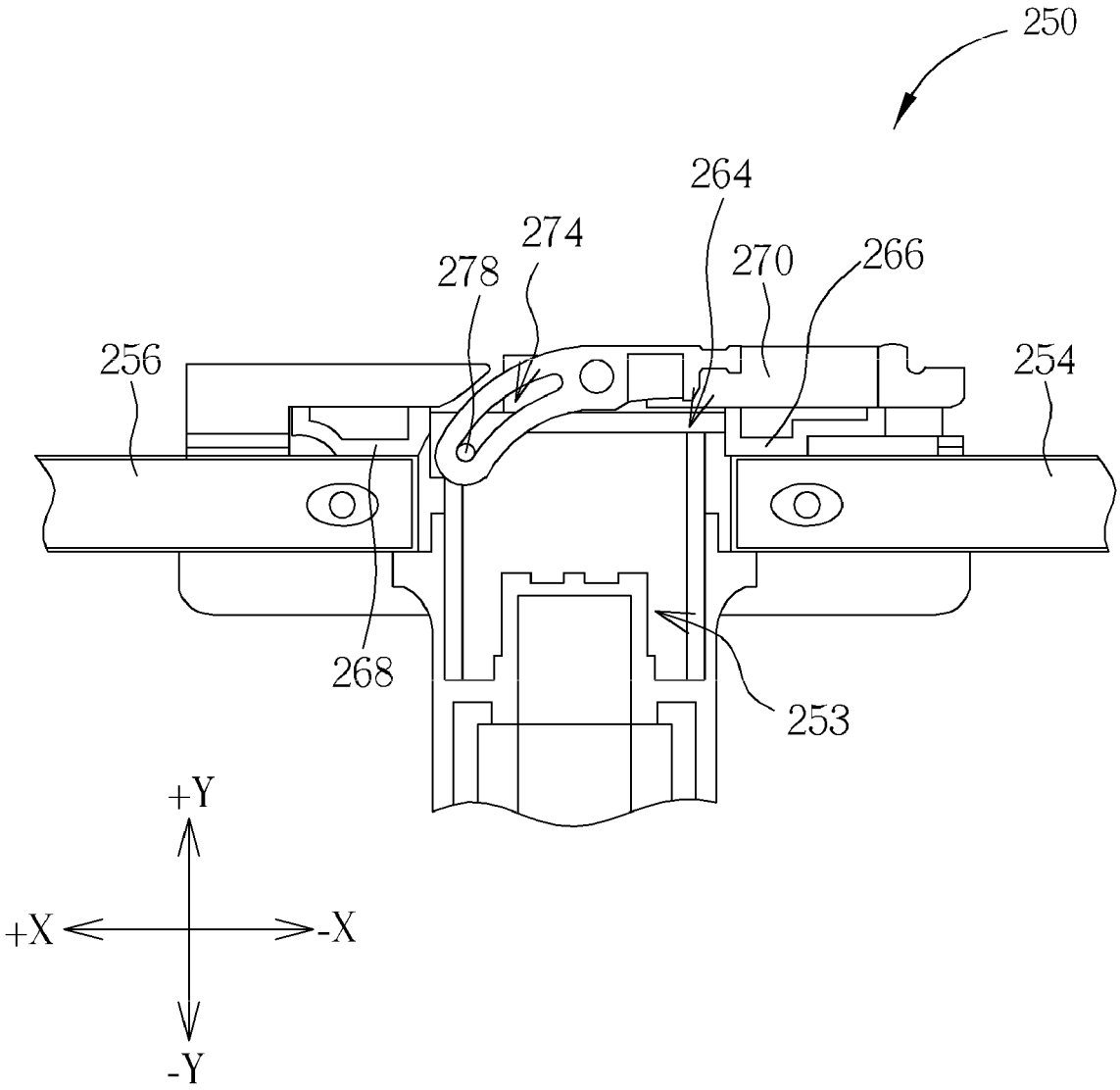
FIG. 18 is a cross-sectional diagram of the playpen hub assembly in FIG. 17 being in a lock state.

Next, please refer to FIG. 16 and FIG. 17. FIG. 16 is an exploded diagram of a playpen hub assembly 250 according to the fifth embodiment of the present invention. FIG. 17 is an assembly diagram of the playpen hub assembly 250 in FIG. 16. As shown in FIG. 16, the playpen hub assembly 250 comprises a base 252, a first support part 254, and a second support part 256. The base 252 has a base body 253. A first rail 260 is formed in the base body 253. When the playpen hub assembly 250 is in a lock state, the first rail 260 is substantially parallel to the first support part 254 and the second support part 256. The first support part 254 and the second support part 256 are pivoted to two sides of the base body 253 respectively. Both the first support part 254 and the second support part 256 are pipe-shaped structures. In this embodiment, as shown in FIG. 17, the playpen hub assembly 250 further comprises four support parts 258. One end of each support part 258 is pivoted to the base body 253 with the first support part 254 and the second support part 256 in a radial manner, and the other end is pivoted to the playpen frame 18 as shown in FIG. 3, or forms an L-shaped support foot to support the playpen hub assembly 250. In other words, the playpen frame 18 is steadily supported by the first support part 254, the second support part 256, and the four support parts 258. It should be noted that number of the support parts varies with different playpen frame designs. The base 252 comprises an upper lid 262, a slider 264, a handle 270, and a spring 272. The upper lid 262 is fixed to the base body 253. The handle 270 is rotatably connected to the upper lid 262 with a rivet. One end of the handle 270 forms an arc-shaped structure and has a second rail 274 corresponding to the arc-shaped structure (i.e. an arc-shaped rail), and the other end has an opening 275. The slider 264 is movably disposed in the first rail 260 of the base body 253. A first block structure 266 and a second block structure 268 are disposed respectively under two ends of the slider 264. The first block structure 266 and the second block structure 268 are arc-shaped protruding structures respectively corresponding to the first support part 254 and the second support part 256. As shown in FIG. 16, the slider 264 has a slot-shaped opening 276. The slot-shaped opening 276 is located between the first block structure 266 and the second block structure 268. The slot-shaped opening 276 is used to provide room for rotation of the first support part 254 relative to the base body 253. The handle 270 is used to move the slider 264 from a lock position to a release position along the first rail 260 for allowance of rotation of the first support part 254 and the second support part 256 relative to the base body 253. The spring 272 is disposed at a pivoted position of the handle 270 and the upper lid 262. Two ends of the spring 272 abut against the handle 270 and the upper lid 262 respectively. The spring 272 is used for providing the handle 270 with elastic restoring force. In another embodiment, the spring 272 may also be changed to connect to the base body 253 and the slider 264 directly for providing the slider 264 with elastic restoring force, so that the slider 264 may be moved back to the lock position automatically. Furthermore, the base 252 further comprises a linkage part 278. The linkage part 278 is disposed through the slider 264 and the second rail 274 of the handle 270 (as shown in FIG. 18). The linkage part 278 may be a pin. When the handle 270 rotates relative to the upper lid 262, the linkage part 278 moves along the second rail 274 so as to drive the slider 264 to move along the first rail 260.

Figure 19:
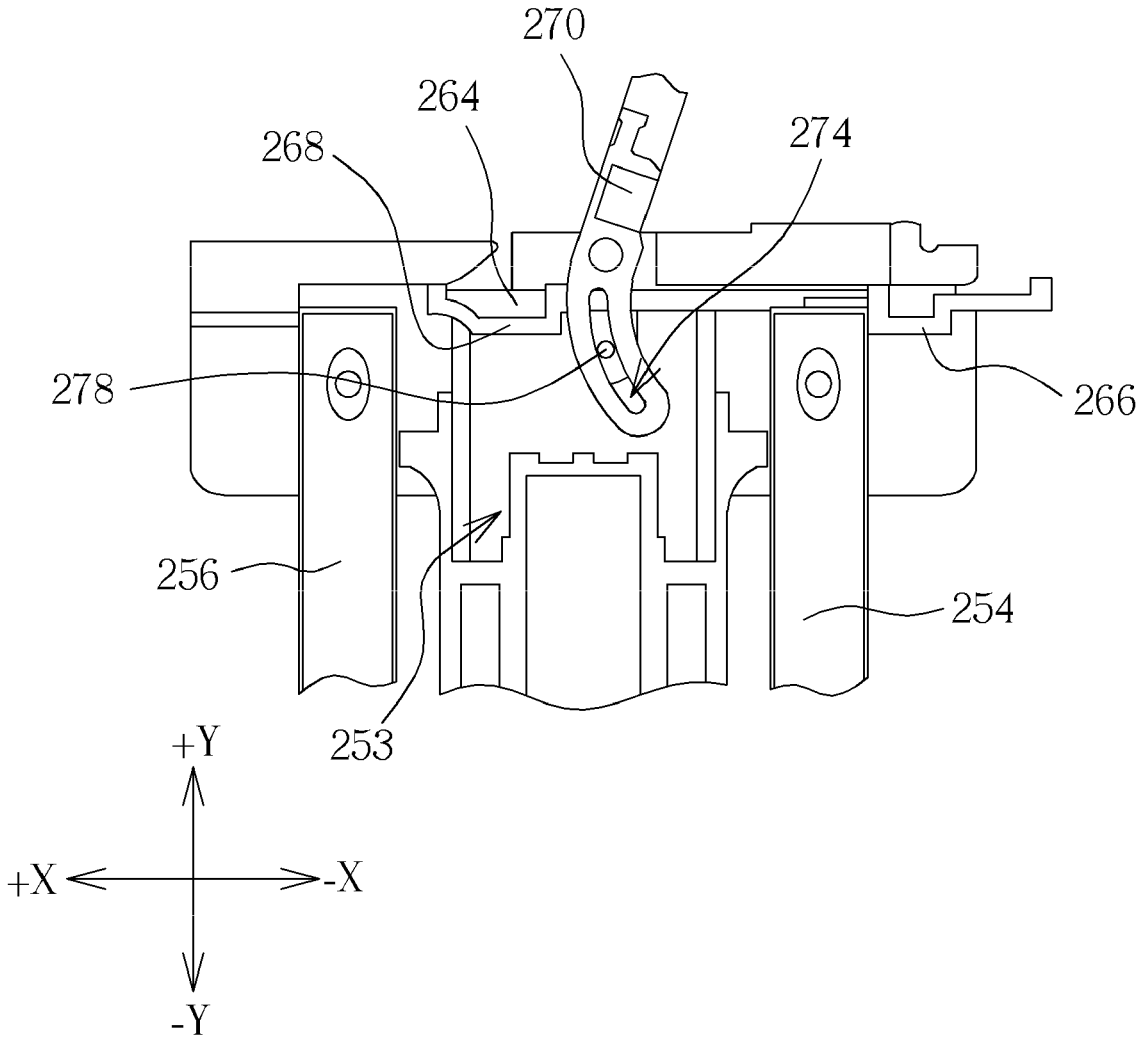
FIG. 19 is a cross-sectional diagram of the playpen hub assembly in FIG. 17 being in a release state.

More detailed description for the playpen hub assembly 250 is provided as follows. Please refer to FIG. 18 and FIG. 19. FIG. 18 is a cross-sectional diagram of the playpen hub assembly 250 in FIG. 17 in a lock state. FIG. 19 is a cross-sectional diagram of the playpen hub assembly 250 in FIG. 17 in a release state. When the playpen hub assembly 250 is in the lock state, as shown in FIG. 18, the first block structure 266 and the second block structure 268 abut against the first support part 254 and the second support part 256 respectively for constraining rotation of the first support part 254 and the second support part 256 relative to the base body 253. As shown in FIG. 18, when the user wants to unfold the playpen frame 18, the user just needs to rotate the handle 270 counterclockwise from the position as shown in FIG. 18 to the position as shown in FIG. 19 relative to the base body 253. At this time, the linkage part 278 may move the slider 264 along the second rail 274 with rotation of the handle 270 so as to move the first block structure 266 and the second block structure 268 on the slider 264 toward a −X-axis direction along the first rail 260. After the slider 264 is moved to the release position as shown in FIG. 19 in the −X-axis direction, as shown in FIG. 19, the user then needs to grasp the opening 275 of the handle 270 and lift the handle 270 toward the −Y-axis direction so that the first support part 254 and the second support part 256 may start to rotate relative to the base body 253. In such a manner, the user may fold the playpen frame 18 up accordingly (as shown in FIG. 19). Unlike other embodiments, in the fifth embodiment, the handle 270 cannot be moved back to the position as shown in FIG. 18 by elastic restoring force provided from the spring 272 since the first block structure 266 may abut against the first support part when the playpen frame 18 is folded up. In other words, the slider 264 cannot return to the lock position when the playpen frame 18 is folded up. Similarly, if the user wants to unfold the playpen frame 18 again, the user just needs to push the base 252 toward the −Y-axis direction so that the first support part 254 and the second support part 256 may respectively rotate from the position as shown in FIG. 19 to the position as shown in FIG. 18 relative to the base body 253. When the first support part 254 and the second support part 256 respectively rotate to the position as shown in FIG. 18 relative to the base body 253, the first support part 254 may no longer abut against the first block structure 266. Thus, by elastic restoring force provided from the spring 272, the handle 270 may be rotated clockwise from the position as shown in FIG. 19 to the position as shown in FIG. 18 relative to the base body 253. At the same time, the linkage part 278 may move the slider 264 along the second rail 274 with rotation of the handle 270 so that the first block structure 266 and the second block structure 268 of the slider 270 may be moved toward the +X-axis direction. After the slider 264 is moved to the lock position as shown in FIG. 18 along the first rail 260, and the first support part 254 and the second support part 256 rotate to the position as shown in FIG. 18 relative to the base body 253, the first block structure 266 and the second block structure 268 may respectively abut against the first support part 254 and the second support part 256 again (as shown in FIG. 18). Therefore, rotation of the first support part 254 and the second support part 256 relative to the base body 253 may be constrained so as to cause the playpen hub assembly 250 to be in the lock state for further use.

Figure 20:
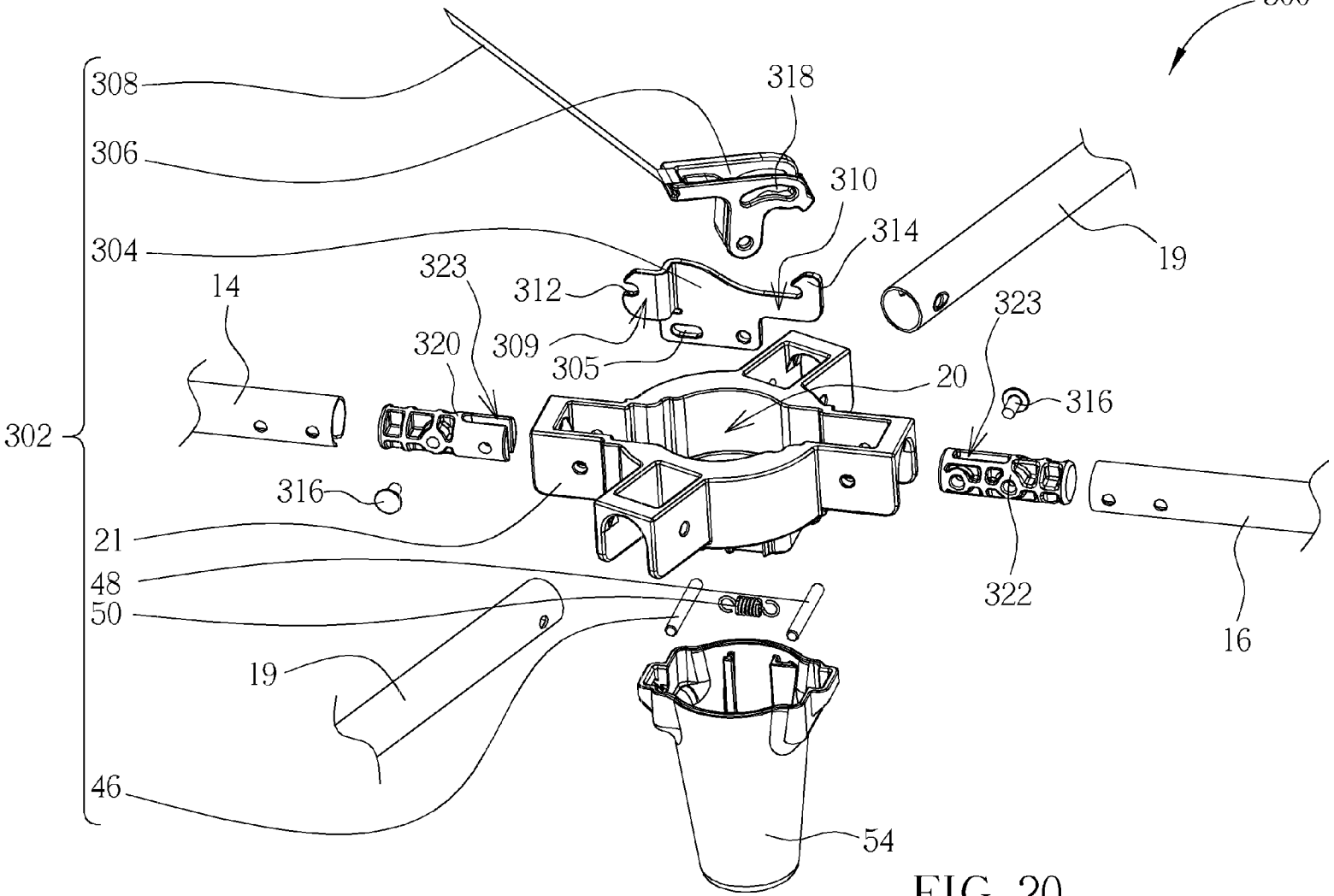
FIG. 20 is an exploded diagram of the playpen hub assembly according to the sixth embodiment of the present invention.

Please refer to FIG. 20, which is an exploded diagram of a playpen hub assembly 300 according to the sixth embodiment of the present invention. Components, functions, and positions both mentioned in the sixth embodiment and the first embodiment represent similar components, functions, and positions. As shown in FIG. 20, the playpen hub assembly 300 comprises a base 302, the first support part 14, and the second support part 16. The base 302 comprises a slider 304, a driving part 306, and a pulling part 308. The slider 304 is disposed in the first rail 20 of the base body 21 and is capable of moving between a release position and a lock position along the first rail 20. A first block structure 309 and a second block structure 310 are formed on two ends of the slider 304 respectively. The first block structure 309 is used for constraining rotation of the first support part 14 relative to the base body 21, and the second block structure 310 is used for constraining rotation of the second support part 16 relative to the base body 21. The first block structure 309 has a first hook 312 and a protruding part 316 corresponding to the first hook 312, and the second block structure 310 has a second hook 314 and a protruding part 316 corresponding to the second hook 314. Furthermore, the driving part 306 is pivoted to the base body 21 via the first connecting rod 46. A second rail 318 is formed on one end of the driving part 306. In such a manner, the slider 304 may be moved along the first rail 20 due to the engagement of the driving part 306 with the first rail 20 and the second rail 318 when the driving part 306 rotates relative to the first connecting rod 46. Furthermore, the first connecting rod 46 passes through a first slot 305 of the slider 304 and is fixed to the base body 21, and the second connecting rod 48 passes through the slider 304 and the second rail 318 of the driving part 306. Thus, the slider 304 may be connected to the base body 21 slidably, and the second connecting rod 48 may move relative to the base body 21 with the slider 304. The playpen hub assembly 300 further comprises a first plastic plug 320 fixed to one end of the first support part 14 and a second plastic plug 322 fixed to one end of the second support part 16. Both the first plastic plug 320 and the second plastic plug 322 have a groove 323 for guidance of the slider 304. One protruding part 316 is disposed through the first support part 14 and the first plastic plug 320, and the other protruding part 316 is disposed through the second support part 16 and the second plastic plug 322. The protruding parts 316 may be a T-shaped rivet in this embodiment, and may also be a common pin in another embodiment. The first hook 312 is used for engaging with the protruding part 316 on the first support part 14, and the second hook 314 is used for engaging with the protruding part 316 on the second support part 16. Furthermore, as shown in FIG. 20, the base 12 further comprises the elastic part 50. The elastic part 50 is connected to the first connecting rod 46 and the second connecting rod 48. The elastic part 50 may be preferably a spring. The elastic part 50 is used for providing elastic restoring force to the slider 304 when the slider 304 moves relative to the base body 21. It should be mentioned that connection of the elastic part 50, the slider 304, and the base body 21 is not limited to the said method. For example, the elastic part 50 may also be connected to the slider 304 and the base body 21 directly.

Figure 21:
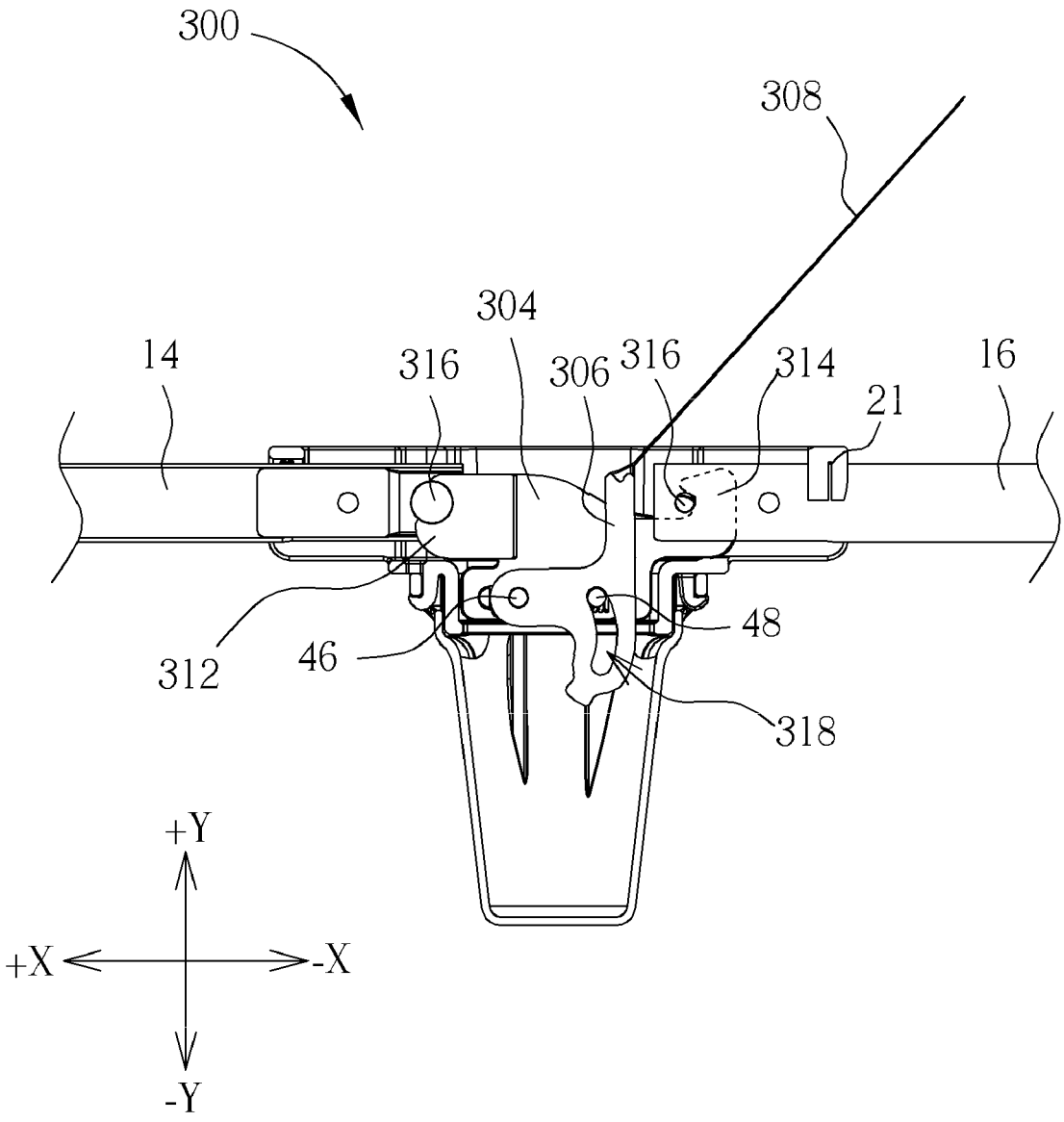
FIG. 21 is a cross-sectional diagram of the playpen hub assembly in FIG. 20 being in a lock state.
Figure 22:
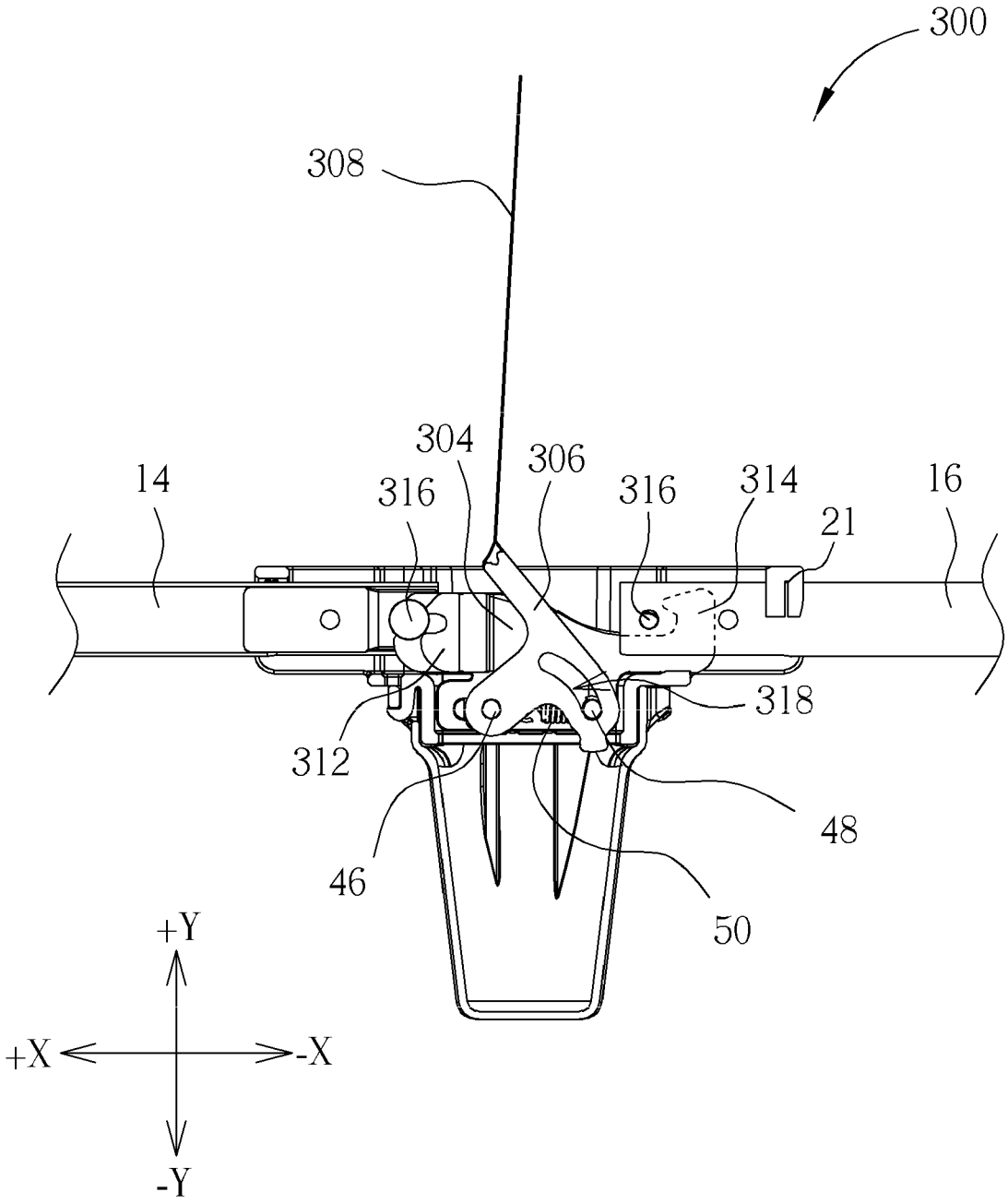
FIG. 22 is a cross-sectional diagram of the playpen hub assembly in FIG. 20 being in a release state.
Figure 23:
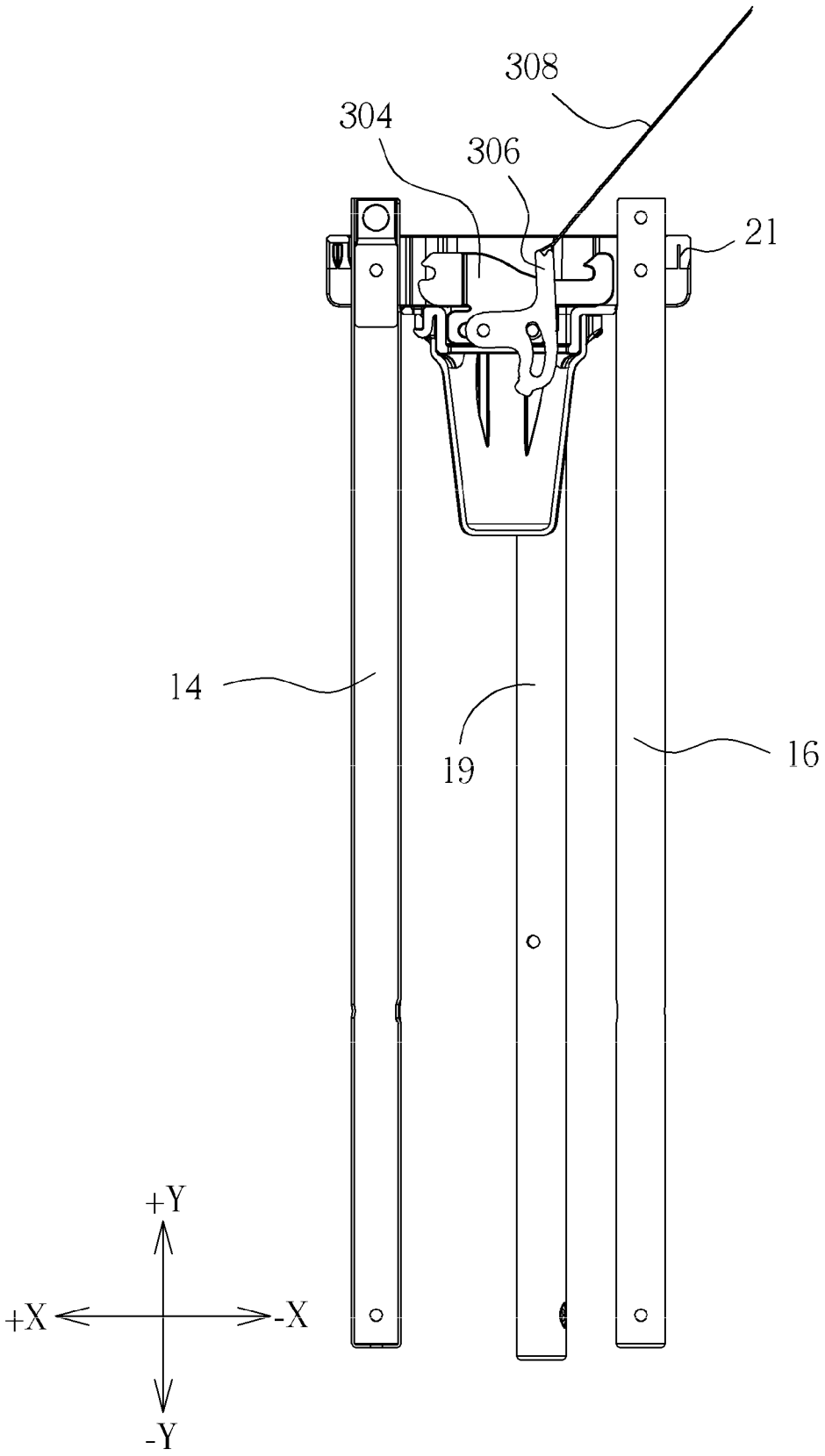
FIG. 23 is a folded diagram of the playpen hub assembly in FIG. 22.

More detailed description for the playpen hub assembly 300 is provided as follows. Please refer to FIG. 21 and FIG. 22. FIG. 21 is a cross-sectional diagram of the playpen hub assembly 300 in FIG. 20 being in a lock state. FIG. 22 is a cross-sectional diagram of the playpen hub assembly 300 in FIG. 20 being in a release state. As shown in FIG. 21, when the playpen hub assembly 300 is in the lock state, the first hook 312 may be engaged with the protruding part 316 on the first support part 14 with the guidance of the groove 323 on the first plastic plug 320, and the second hook 314 may be engaged with the protruding part 316 on the second support part 16 with the guidance of the groove 323 on the second plastic plug 322. Thus, rotation of the first support part 14 and the second support part 16 relative to the base body 21 may be constrained. On the other hand, when the user wants to fold the playpen frame 18 up, the user may need to pull the pulling part 308 to rotate the driving part 306 from the position as shown in FIG. 21 to the position as shown in FIG. 22 relative to the base body 21. At the same time, the slider 304 may move along the first rail 20 in the −X-axis direction with rotation of the driving part 306 via assembly of the slider 304, the first rail 20, and the second rail 318 (at this time, the elastic part 50 is in an extended state). As a result, the first hook 312 and the second hook 314 of the slider 304 may also move toward the −X-axis direction. After the first hook 312 and the second hook 314 are no longer engaged with the protruding parts 316 on the first support part 14 and the second support part 16 respectively, meaning that the slider 304 has moved to the release position as shown in FIG. 22, the user then needs to lift the base body 21 via the pulling part 308 so that the first support part 14, the second support part 16, and the support parts 19 may rotate to the position as shown in FIG. 23 relative to the base body 21 (FIG. 23 is a folded diagram of the playpen hub assembly 300 in FIG. 22). In such a manner, the playpen frame 18 may be folded up accordingly, at which point the slider 304 may be moved back to the lock position as shown in FIG. 21 by elastic restoring force provided from the elastic part 50. Similarly, if the user wants to unfold the playpen frame 18 again, the user may push the first support part 14 and the second support part 16 to rotate relative to the base body 21. After the first support part 14 and the second support part 16 rotate a specific angle, the protruding parts 316 on the first support part 14 and the second support part 16 may abut against the first hook 312 and the second hook 314 respectively. Since both the first hook 312 and the second hook 314 have an inclined surface structure, the protruding parts 316 on the first support part 14 and the second support part 16 may push the first hook 312 and the second hook 314 to move toward the −X-axis direction along the said inclined surface structures respectively. In other words, the slider 304 is pushed to move toward the −X-axis direction (at this time, the elastic part 50 is in an extended state). After the first support part 14 and the second support part 16 rotate to the position as shown in FIG. 22 relative to the base body 21, the slider 304 may be moved back to the lock position as shown in FIG. 21 in the +X-axis direction by elastic restoring force provided from the elastic part 50 so that the first hook 312 and the second hook 314 may respectively be engaged with the first support part 14 and the second support part 16 again. As a result, rotation of the first support part 14 and the second support part 16 relative to the base body 21 may be constrained so as to cause the playpen hub assembly 300 to be in the lock state for further use.

Figure 24:
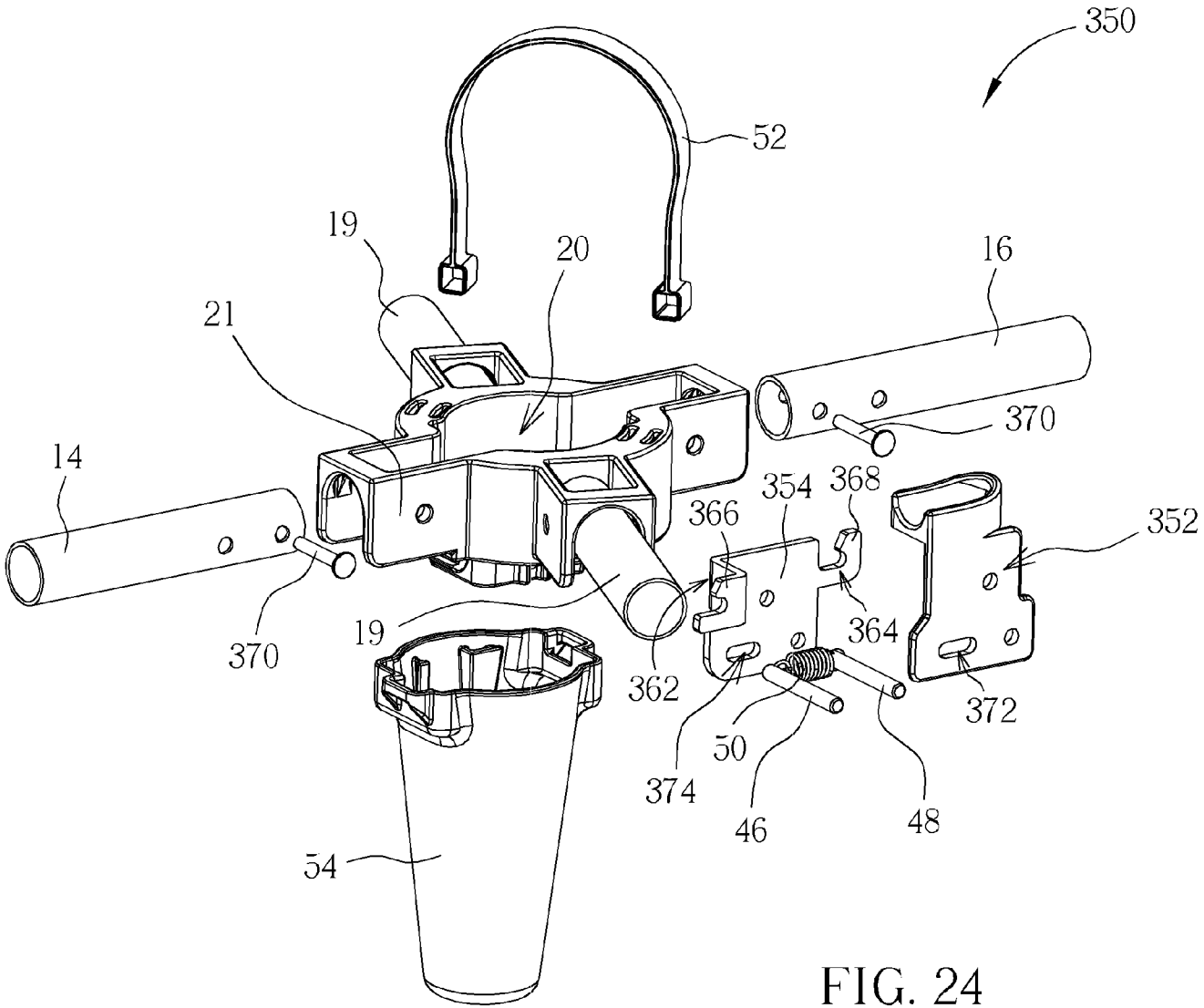
FIG. 24 is an exploded diagram of the playpen hub assembly according to the seventh embodiment of the present invention.
Figure 25:
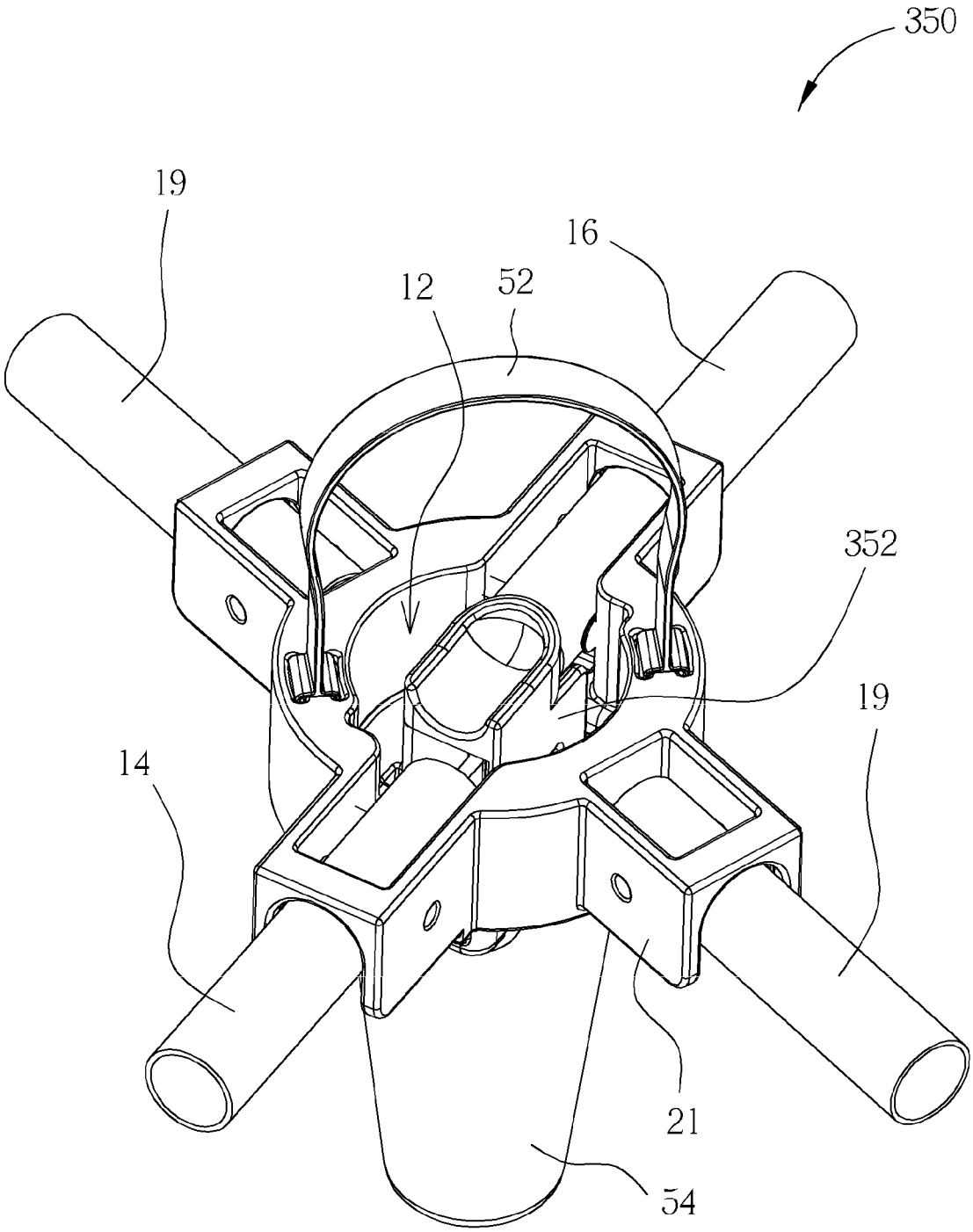
FIG. 25 is an assembly diagram of the playpen hub assembly in FIG. 24.
Figure 26:
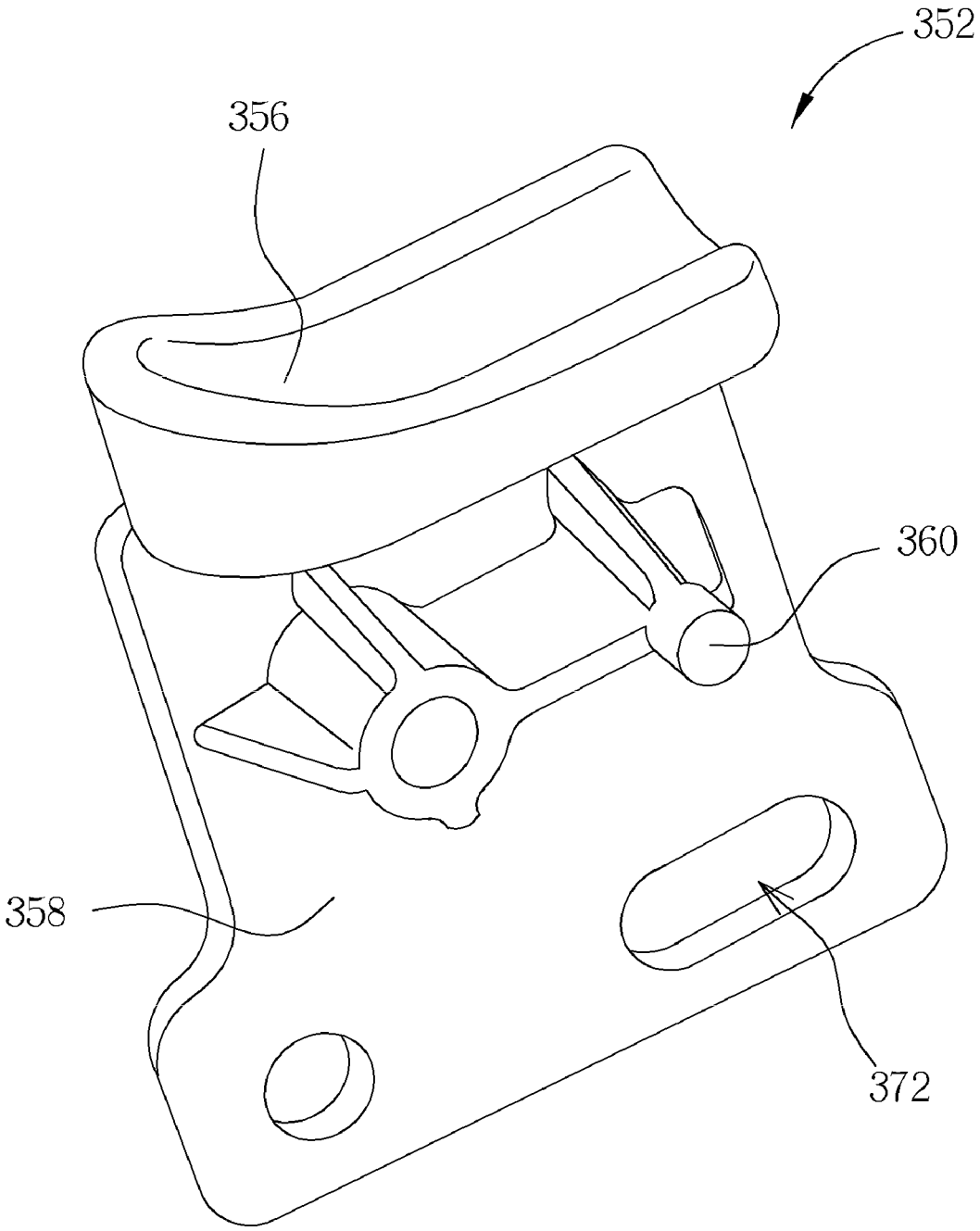
FIG. 26 is an enlarged diagram of the driving part in FIG. 24.

Next, please refer to FIG. 24 and FIG. 25. FIG. 24 is an exploded diagram of a playpen hub assembly 350 according to the seventh embodiment of the present invention. FIG. 25 is an assembly diagram of the playpen hub assembly 350 in FIG. 24. Components, functions and positions both mentioned in the first embodiment and the seventh embodiment represent similar components, functions and positions, and the related description is therefore omitted herein. Differences between the playpen hub assembly 350 and the playpen hub assembly 10 are the structural designs of the driving part and the slider. The playpen hub assembly 350 comprises a driving part 352 and a slider 354. Next, please refer to FIG. 26, which is an enlarged diagram of the driving part 352 in FIG. 24. As shown in FIG. 26, the driving part 352 comprises a push button 356 and an extended pad 358 disposed under the push button 356. The extended pad 358 has a protruding part 360. The protruding part 360 is used for passing through the slider 354 to fix the driving part 352 to the slider 354. The slider 354 is movably disposed in the first rail of the base body 21 and is capable of moving between a release position and a lock position along the first rail 20. As shown in FIG. 24, the slider 354 has a first block structure 362 and a second block structure 364. The first block structure 362 and the second block structure 364 have a first hook 366 and a second hook 368 respectively. The first support part 14 has a protruding part 370 corresponding to the first hook 366, and the second support part 16 has a protruding part 370 corresponding to the second hook 368. When the slider 354 is located at the lock position, the first hook 366 of the first block structure 362 and the second hook 368 of the second block structure 364 are engaged with the protruding parts 370 on the first support part 14 and the second support part 16 respectively. Furthermore, the first connecting rod 46 of the base 12 is fixed to the base body 21 and is disposed through a first slot 372 of the driving part 352 and a second slot 374 of the slider 354, so that the first slot 372 of the driving part 352 and the second slot 374 of the slider 354 may move relative to the first connecting rod 46. The second connecting rod 48 is fixed to the driving part 352 and the slider 354 and is movably connected to the base body 21, so that the second connecting rod 48 may move relative to the base body 21 with the driving part 352 and the slider 354. As mentioned in the said embodiments, the elastic part 50 is connected to the first connecting rod 46 and the second connecting rod 48 for providing elastic restoring force to the driving part 352 and the slider 354 when the driving part 352 and the slider 354 move relative to the base body 21. Furthermore, as shown in FIG. 24, the playpen hub assembly 350 further comprises a pulling part 52, which is installed on the base body 21. In such a manner, the user may grasp the pulling part 52 to lift the base body 21 upward when the playpen hub assembly 350 is in the release state. As for an operating process of the playpen hub assembly 350, it is the same as that of the playpen hub assembly 10, and the related description is omitted herein.

Figure 27:
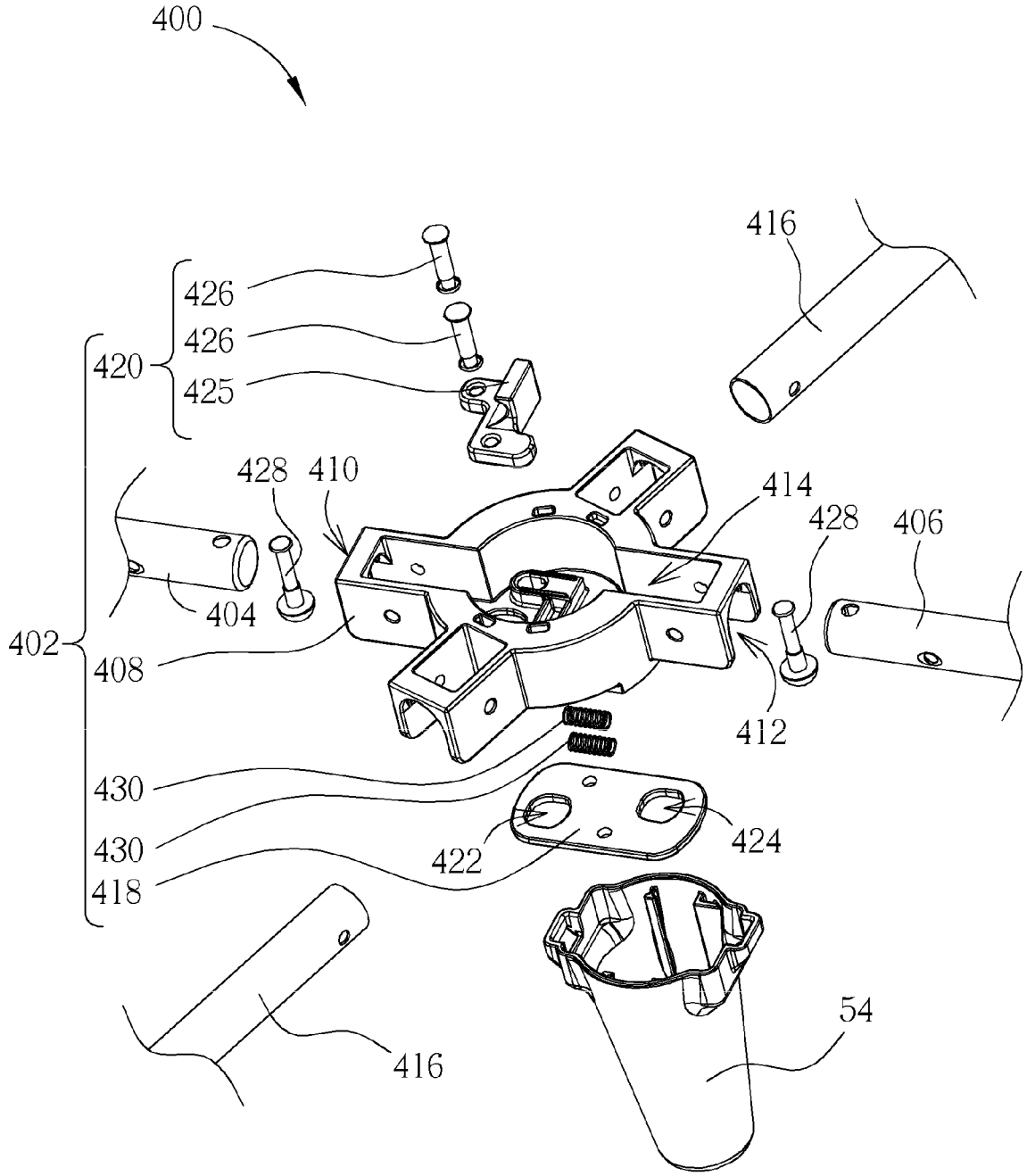
FIG. 27 is an exploded diagram of the playpen hub assembly according to the eighth embodiment of the present invention.
Figure 28:
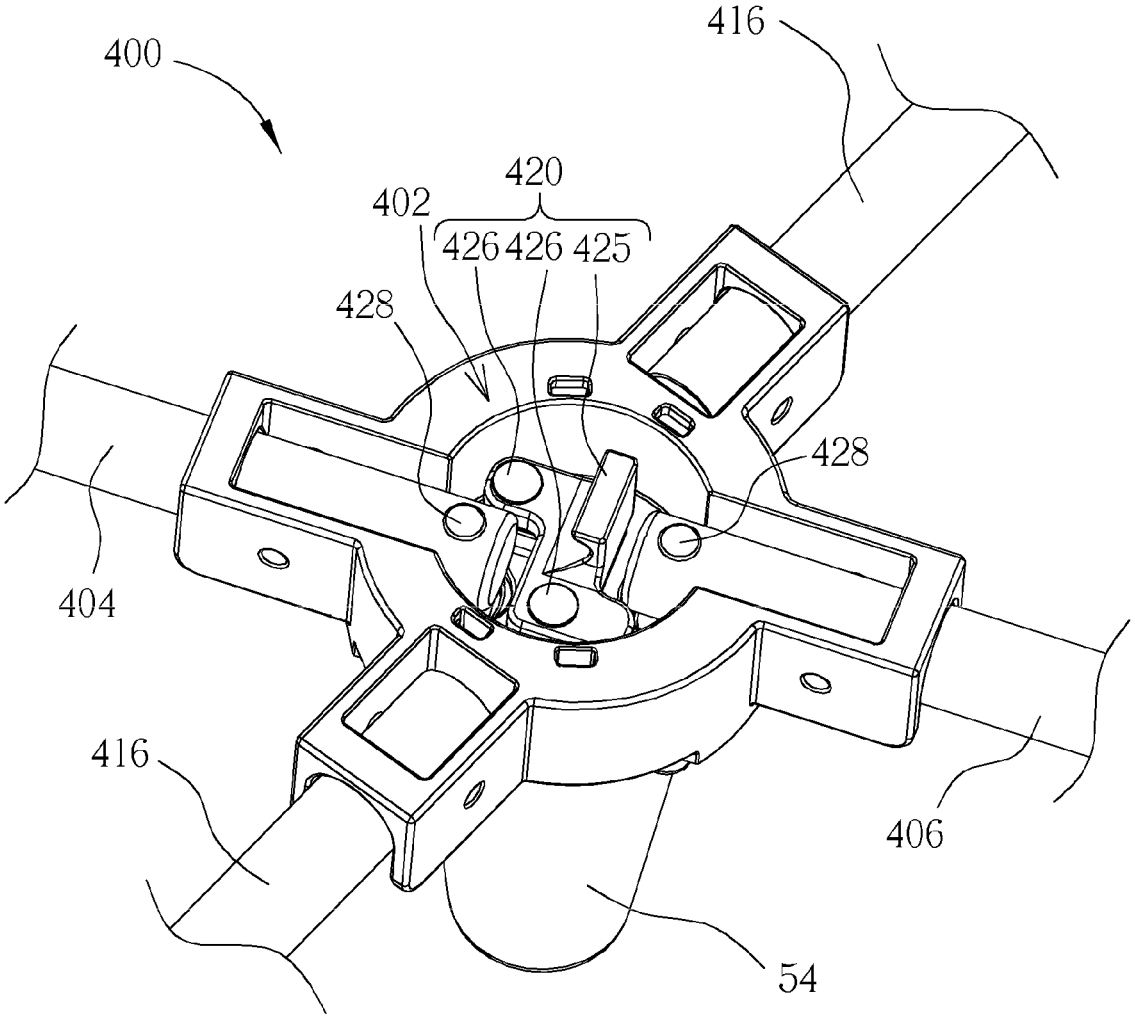
FIG. 28 is an assembly diagram of the playpen hub assembly in FIG. 27.

Next, please refer to FIG. 27 and FIG. 28. FIG. 27 is an exploded diagram of a playpen hub assembly 400 according to the eighth embodiment of the present invention. FIG. 28 is an assembly diagram of the play pen hub assembly 400 in FIG. 27. As shown in FIG. 27, the playpen hub assembly 400 comprises a base 402, a first support part 404, and a second support part 406. The base 402 has a base body 408. Two ends of the base body 408 have a first pivot slot 410 and a second pivot slot 412 respectively. A first rail 414 is formed in the base body 408 and is accessible to the first pivot slot 410 and the second pivot slot 412. The first rail 414 is substantially parallel to the first support part 404 and the second support part 406 when the playpen hub assembly 400 is in a lock state. One end of the first support part 404 and one end of the second support part 406 are pivoted to the first pivot slot 410 and the second pivot slot 412 of the base body 408 respectively. The first support part 404 and the second support part 406 are pipe-shaped structures. The playpen hub assembly 400 further comprises two support parts 416, which are pivoted to the base body 408 and the playpen frame 18 with the first support part 404 and the second support part 406 in a radial manner. The connection method of the support parts 416 is the same as that mentioned in the first embodiment, and the related description is therefore omitted herein. The base 402 comprises a slider 418 and a driving part 420. The slider 418 is movably disposed in the first rail 414 of the base body 408, and is capable of moving between a release position and a lock position along the first rail 414. The slider 418 has a first block structure 422 and a second block structure 424. The first block structure 422 is used for constraining rotation of the first support part 404 relative to the base body 408, and the second block structure 424 is used for constraining rotation of the second support part 406 relative to the base body 408. The driving part 420 comprises a push button 425 and at least one fixing part 426 (two shown in FIG. 27). The fixing part 426 is disposed through the base body 408 and fixes the push button 425 to the slider 418 for moving the slider 418 together with the driving part 420. The fixing part 426 may be preferably a rivet. The driving part 420 is used for driving the slider 418 to move to the release position, so that the first support part 404 and the second support part 406 may be capable of rotating to a mutually parallel position relative to the base body 408 for folding of the playpen frame 18.

Figure 29:
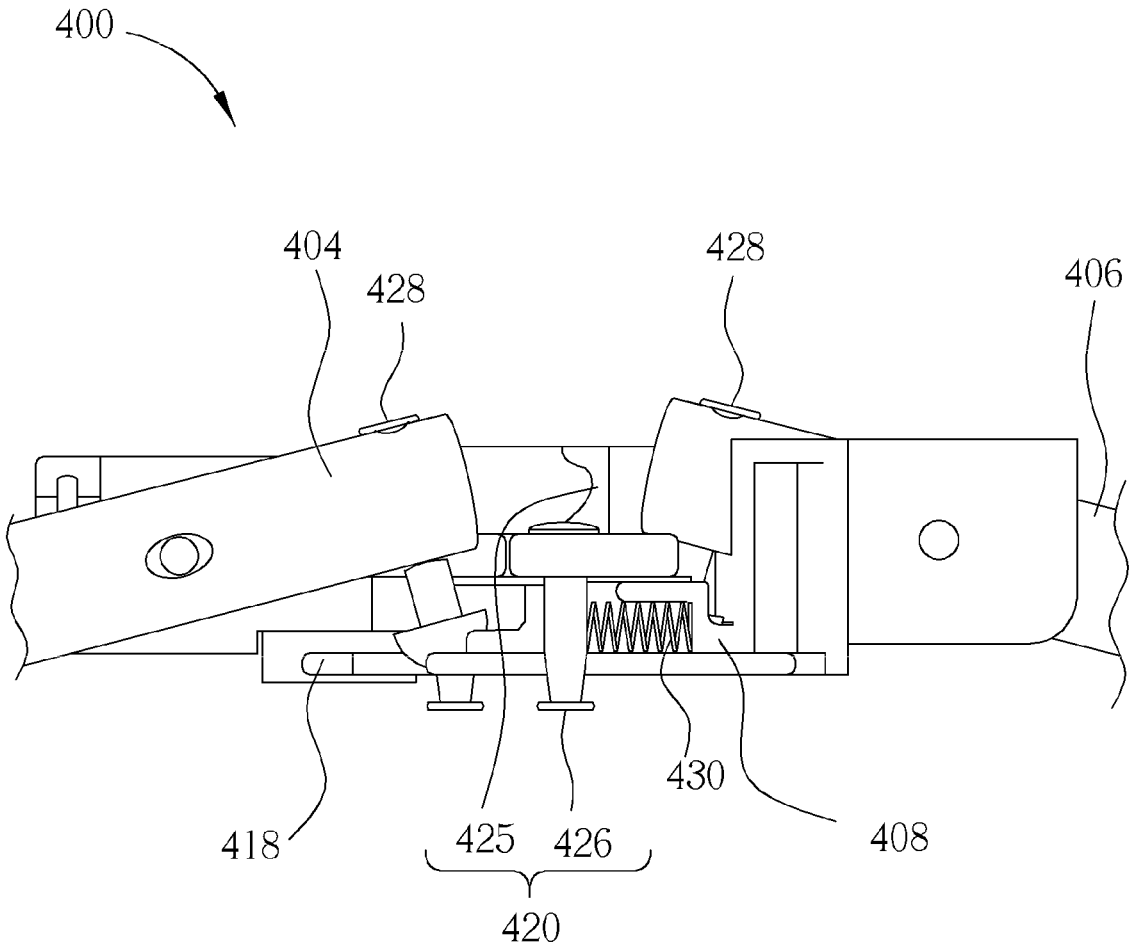
FIG. 29 is a partial cross-sectional diagram of the elastic part in FIG. 27 abutting against the fixing part and the base body.

Furthermore, as shown in FIG. 27, both the first block structure 422 and the second block structure 424 are a hole structure. The first support part 404 comprises a protruding part 428 corresponding to the first block structure 422, and the second support part 406 comprises a protruding part 428 corresponding to the second block structure 424. When the slider 418 is located at the lock position, the protruding parts 428 of the first support part 404 and the second support part 406 are engaged with the first block structure 422 and the second block structure 424 respectively. The base 402 comprises at least one elastic part 430 (two shown in FIG. 27). Please refer to FIG. 29, which is a partial cross-sectional diagram of the elastic part 430 in FIG. 27 abutting against the fixing part 426 and the base body 408. As shown in FIG. 29, two ends of the elastic part 430 respectively abut against the fixing part 426 of the driving part 420 and the base body 408 for providing elastic restoring force to the slider 418 so that the slider 418 may be moved from the release position to the lock position automatically.

Figure 30:
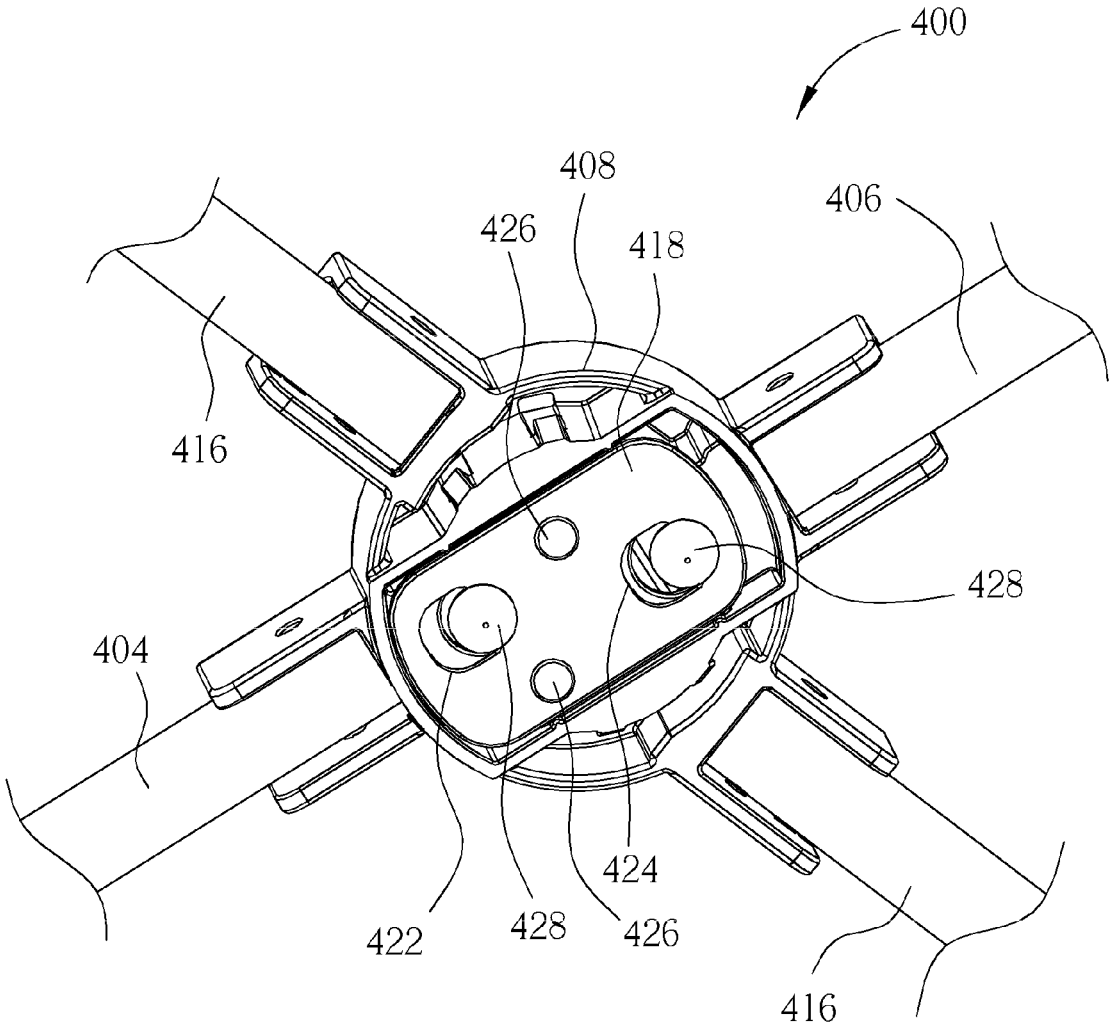
FIG. 30 is a diagram of the playpen hub assembly in FIG. 28 being in a lock state.
Figure 31:
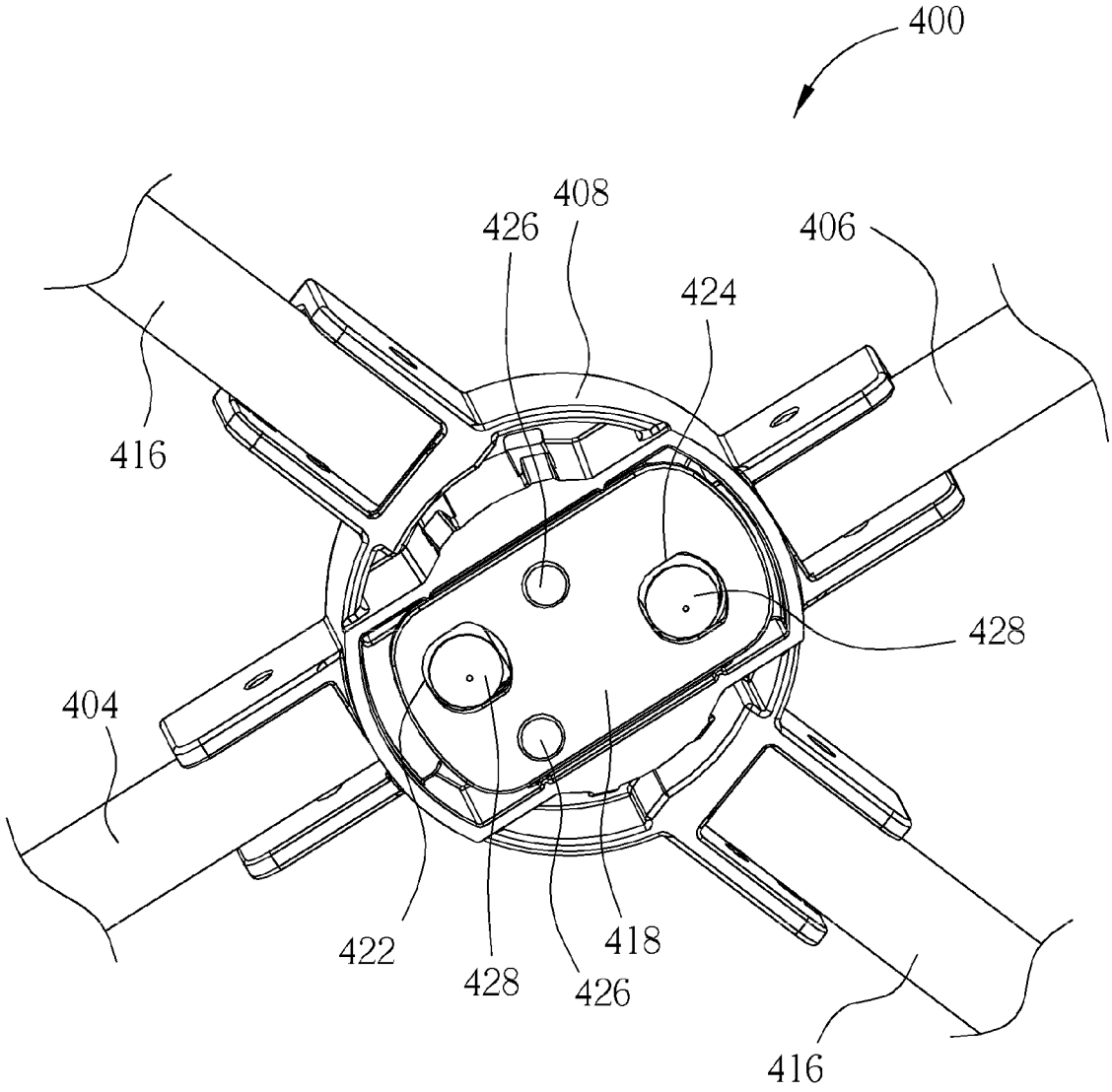
FIG. 31 is a diagram of the playpen hub assembly in FIG. 28 being in a release state.

More detailed description for the playpen hub assembly 400 is provided as follows. Please refer to FIG. 30 and FIG. 31. FIG. 30 is a diagram of the playpen hub assembly 400 in FIG. 28 being in a lock state. FIG. 31 is a diagram of the playpen hub assembly 400 in FIG. 28 being in a release state. As shown in FIG. 30, when the playpen hub assembly 400 is in the lock state, the slider 418 is located at the lock position, at which point the protruding parts 428 of the first support part 404 and the second support part 406 are engaged with the first block structure 422 and the second block structure 424 respectively for constraining rotation of the first support part 404 and the second support part 406 relative to the base body 408. Thus, the first support part 404, the second support part 406, and two support parts 416 may be kept arranged in a radial manner for causing the playpen frame 18 to be in an unfolded state. On the other hand, if the user wants to fold the playpen frame 18 up, the user just needs to push the push button 425 on the driving part 420 so that the slider 418 may be moved to the release position as shown in FIG. 31 via the fixing part 426 correspondingly. At this time, the fixing parts 426 of the first support part 404 and the second support part 406 are no longer engaged with the first block structure 422 and the second block structure 424. Subsequently, as long as the user lifts the driving part 420 upward, the protruding parts 428 of the first support part 404 and the second support part 406 may be released from the first block structure 422 and the second block structure 424 respectively at the same time, so that the first support part 404 and the second support part 406 may rotate relative to the base body 408 accordingly. Finally, as long as the user keeps lifting the driving part 420 upward until the first support part 404 and the second support part 406 rotate to a mutually parallel position, the user may release the driving part 420 to complete the folding process of the playpen frame 18. Subsequently, the slider 418 may also be moved back to the lock position as shown in FIG. 30 by elastic restoring force provided from the elastic part 430. Similarly, if the user wants to unfold the playpen frame 18 again, the user may just push the driving part 420 to move the slider 418 to the release position as shown in FIG. 31 and then press the base 402 of the playpen hub assembly 400 downward, so that the first support part 404 and the second support part 406 may rotate relative to the base body 408. After the fixing parts 426 of the first support part 404 and the second support part 406 abut against the slider 418 and pass through the first block structure 422 and the second block structure 424 respectively, the user may release the driving part 420 and stop pressing the base 402. At this time, the slider 418 may be moved back to the lock position as shown in FIG. 30 by elastic restoring force provided from the elastic part 430, and the fixing parts 426 of the first support part 404 and the second support part 406 may be engaged with the first block structure 422 and the second block structure 424 respectively. In such a manner, the playpen hub assembly 400 may be in the lock state for further use since the first support part 404 and the second support part 406 are incapable of rotating relative to the base body 408 due to the engagement of the engaging protruding parts 428, the first block structure 422, and the second block structure 424.

Finally, it should be noted that the structural design of the pulling part mentioned in the first embodiment may also be applied to other embodiments of the present invention. For example, in the eighth embodiment, the playpen hub assembly 400 may further comprise a pulling part (not shown in the said figures). The pulling part may be connected to either one of the base body 408 and the driving part 420. That is to say, when the slider 418 is moved to the release position, the user may utilize the pulling part to move the base 402 toward a direction perpendicular to the first rail 414 so as to make the first support part 404 and the second support part 406 be capable of rotating relative to the base body 408. In summary, structural design of the pulling part mentioned in the first embodiment may be applied to other embodiments of the present invention in the said manner.

Compared with the prior art, in which a knife-shaped hook is utilized to hook a support pipe laterally, or a hook formed on a base is utilized to vertically engage with a corresponding slot on a support pipe for constraining rotation of the support pipe relative to the base, the present invention involves utilizing a block structure on a slider for constraining rotation of the support pipe relative to the base and pushing the slider to release restriction for the support part so that the support part may rotate relative to the base. Thus, a playpen hub assembly provided by the present invention may not only simplify complexity of structural design, but also increases safety in use of a playpen considerably via the two-step release processes mentioned in the said embodiments (e.g. the process of pushing the push button and then lifting the base upward mentioned in the first embodiment).

Those skilled in the art will readily observe that numerous modifications and alterations of the device and method may be made while retaining the teachings of the invention.

What is claimed is:

1. A playpen hub assembly comprising:

a base having a base body, wherein a first rail is formed on the base and the base comprises:

a slider movably disposed in the first rail for moving between a lock position and a release position along the first rail; and a driving part connected to the slider;

a first support part pivoted to a side of the base; and a second support part pivoted to another side of the base;

wherein one end of the slider has a first block structure for constraining rotation of the first support part relative to the base body, another end of the slider has a second block structure for constraining rotation of the second support part relative to the base body, and the driving part is used for driving the first block structure and the second block structure of the slider to move to the release position in one direction along the first rail so as to release restriction of the first block structure for the first support part and restriction of the second block structure for the second support part;

when the slider is located at the lock position, the first rail is substantially parallel to the first support part and the second support part.

2. The playpen hub assembly of claim 1, wherein the base further comprises:

a first connecting rod fixed to the base body and disposed through the slider, the slider being capable of moving relative to the first connecting rod;

a second connecting rod fixed to the slider and movably disposed through the base body; and an elastic part connected to the first connecting rod and the second connecting rod, the elastic part used for providing elastic restoring force to the slider when the slider moves relative to the base body.

3. The playpen hub assembly of claim 1, wherein both the first block structure and the second block structure have a hook, both the first support part and the second support part have an engaging hole corresponding to the hook, and the hooks of the first block structure and the second block structure are engaged with the engaging holes of the first support part and the second support part respectively when the slider is located at the lock position.

4. The playpen hub assembly of claim 1, wherein both the first block structure and the second block structure have a hook, both the first support part and the second support part have a protruding part corresponding to the hook, and the hooks of the first block structure and the second block structure are engaged with the protruding parts of the first support part and the second support part respectively when the slider is located at the lock position.

5. The playpen hub assembly of claim 1, wherein the driving part is fixed to the slider and has a push button located above the slider.

6. The playpen hub assembly of claim 3 further comprising two reinforcing pipes respectively disposed in the first support part and the second support part for engaging with the hooks of the first block structure and the second block structure respectively.

7. The playpen hub assembly of claim 1, wherein the driving part is a flexible part fixed to the slider.

8. The playpen hub assembly of claim 1, wherein the driving part has a main body, a second rail is formed on the main body, the base further comprises a fixing part disposed through the second rail and fixed to the slider, and the fixing part moves along the second rail for moving the slider along the first rail when the main body is rotated.

9. The playpen hub assembly of claim 8, wherein the driving part comprises a grip fixed to the main body, the grip used for driving the main body to rotate or move upward relative to the slider.

10. The playpen hub assembly of claim 1, wherein the base further comprises:

an upper lid fixed to the base body, the driving part pivoted to the upper lid, a second rail being formed on an end of the driving part; and a linkage part disposed through the slider and the second rail of the driving part, the slider being moved along the first rail by the linkage of the linkage part, the first rail, and the second rail when the driving part rotates relative to the upper lid.

11. The playpen hub assembly of claim 10, wherein the end of the driving part is an arc-shaped structure, and the second rail forms an arc-shaped rail corresponding to the arc-shaped structure.

12. The playpen hub assembly of claim 10, wherein the base further comprises a spring disposed at a pivoted position between the driving part and the upper lid, and two ends of the spring abut against the driving part and the upper lid respectively.

13. The playpen hub assembly of claim 10, wherein the first block structure is an arc-shaped protruding structure corresponding to the first support part, and the second block structure is an arc-shaped protruding structure corresponding to the second support part.

14. The playpen hub assembly of claim 10, wherein a slot-shaped opening is formed on the slider, and the slot-shaped opening provides room for rotation of the first support part relative to the base body when the slider is located at the release position.

15. The playpen hub assembly of claim 1, wherein the driving part is pivoted to the base, and the slider is moved along the first rail by the driving part when the driving part rotates relative to the base.

16. The playpen hub assembly of claim 4 further comprising a first plastic plug disposed in the first support part and a second plastic plug disposed in the second support part, one protruding part being disposed through the first support part and the first plastic plug, the other protruding part being disposed through the second support part and the second plastic plug.

17. The playpen hub assembly of claim 1, wherein both the first block structure and the second block structure are an engaging hole, the first support part comprises a protruding part corresponding to the first block structure, the second support part comprises a protruding part corresponding to the second block structure, and the protruding parts of the first support part and the second support part are engaged with the first block structure and the second block structure respectively when the slider is located at the lock position.

18. The playpen hub assembly of claim 17, wherein the driving part comprises a push button and at least one fixing part disposed through the base body, and the fixing part is used for fixing the push button to the slider.

19. The playpen hub assembly of claim 18, wherein the base further comprises at least one elastic part abutting against the fixing part of the driving part and the base body.

20. The playpen hub assembly of claim 1, wherein the base further comprises an elastic part connected to the slider and the base body.

21. The playpen hub assembly of claim 1 further comprising a pulling part connected to either one of the base body and the driving part, the pulling part used for driving the base to move toward a direction perpendicular to the first rail when the slider is moved to the release position so that the first support part and the second support part may rotate relative to the base body.

22. A playpen hub assembly comprising:

a base having a base body, wherein a first rail is formed on the base body, and the base comprises:

a slider movably disposed in the first rail for moving between a lock position and a release position along the first rail; and a driving part connected to the slider;

a first support part pivoted to a side of the base body;

a second support part pivoted to another side of the base body, wherein one end of the slider has a first block structure for constraining rotation of the first support part relative to the base body, another end of the slider has a second block structure for constraining rotation of the second support part relative to the base body, and the driving part is used for driving the first block structure and the second block structure of the slider to move to the release position in one direction along the first rail so as to release restriction of the first block structure for the first support part and restriction of the second block structure for the second support part; and a pulling part connected to either one of the base body and the driving part, the pulling part used for driving the base body when the slider is moved to the release position so that the first support part and the second support part may rotate relative to the base body.

23. The playpen hub assembly of claim 22, wherein the driving part is fixed to the slider and the pulling part is fixed to the base body.

24. The playpen hub assembly of claim 22, wherein the driving part has a main body, a second rail is formed on the main body, the base further comprises a fixing part disposed through the second rail and fixed to the slider, the fixing part is used for moving along the second rail to drive the slider to move along the first rail when the main body is rotated, and the pulling part is fixed to the main body.

25. The playpen hub assembly of claim 22, wherein both the first block structure and the second block structure have a first engaging mechanism, both the first support part and the second support part have a second engaging mechanism corresponding to the first engaging mechanism, and the first engaging mechanisms of the first block structure and the second block structure are engaged with the second engaging mechanisms of the first support part and the second support part respectively when the slider is located at the lock position.

* * * * *